US010138827B2

(12) United States Patent
Dudar

(10) Patent No.: US 10,138,827 B2
(45) Date of Patent: Nov. 27, 2018

(54) EVAPORATIVE EMISSIONS SYSTEM CHECK VALVE MONITOR FOR A MULTI-PATH PURGE EJECTOR SYSTEM

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 33 days.

(21) Appl. No.: 15/398,566

(22) Filed: Jan. 4, 2017

(65) Prior Publication Data

US 2018/0187614 A1 Jul. 5, 2018

(51) Int. Cl.
*F02D 41/00* (2006.01)
*F02M 25/08* (2006.01)

(52) U.S. Cl.
CPC ..... *F02D 41/004* (2013.01); *F02M 25/0827* (2013.01); *F02M 25/0836* (2013.01)

(58) Field of Classification Search
CPC ..... F02D 41/004; F02M 25/0827; F02M 25/0836; F02M 25/08
USPC ..... 123/520, 519, 518, 516
See application file for complete search history.

(56) References Cited

U.S. PATENT DOCUMENTS 8,924,133 B2 12/2014 Hadre et al.
9,255,553 B2 2/2016 Dudar et al.
9,360,125 B2 6/2016 Jefford et al.
9,410,507 B2 8/2016 Pearce et al.
2002/0007669 A1* 1/2002 Ito ..... F01P 11/16 73/114.63
2010/0224171 A1 9/2010 Peters et al.
2014/0257672 A1* 9/2014 Surnilla ..... F02M 25/089 701/103
2014/0299110 A1 10/2014 Heller et al.
2015/0085894 A1* 3/2015 Yang ..... G01M 3/002 374/4
2015/0090235 A1* 4/2015 Pearce ..... F02M 25/0818 123/520

FOREIGN PATENT DOCUMENTS

JP 04292563 A * 10/1992 ..... F02M 25/0809

* cited by examiner

*Primary Examiner* — Mahmoud Gimie
(74) *Attorney, Agent, or Firm* — Julia Voutyras; McCoy Russell LLP

(57) ABSTRACT

Methods and systems are provided for diagnosing functionality of a check valve in a vehicle evaporative emissions system, where the check valve functions to prevent unmetered air from entering engine intake under conditions of engine intake manifold vacuum. In one example, a method may include diagnosing whether the check valve is stuck open based on a temperature change at the fuel vapor canister as monitored by a canister temperature sensor, and responsive to an indication that the check valve is stuck open, taking mitigating actions to reduce undesired emissions. In this way, functionality of such a check valve may be determined periodically, without additional sensors, thus reducing costs while improving emissions.

19 Claims, 11 Drawing Sheets

EVAPORATIVE EMISSIONS SYSTEM CHECK VALVE MONITOR FOR A MULTI-PATH PURGE EJECTOR SYSTEM

FIELD

The present description relates generally to methods and systems for controlling flow and diagnosing components in a fuel vapor recovery system for a vehicle with a boosted internal combustion engine.

BACKGROUND/SUMMARY

Vehicles may be fitted with evaporative emission control systems such as onboard fuel vapor recovery systems. Such systems capture and reduce release of vaporized hydrocarbons to the atmosphere, for example fuel vapors released from a vehicle gasoline tank during refueling. Specifically, the vaporized hydrocarbons (HCs) are stored in a fuel vapor canister packed with an adsorbent which adsorbs and stores the vapors. At a later time, when the engine is in operation, the evaporative emission control system allows the vapors to be purged into the engine intake manifold for use as fuel. The fuel vapor recovery system may include one more check valves, ejectors, and/or controller actuatable valves for facilitating purge of stored vapors under boosted or non-boosted engine operation.

Various approaches have been developed for detecting undesired evaporative emissions and/or degraded components in such fuel vapor recovery systems. However, the inventors have recognized several potential issues with such methods. The inventors have recognized that, in particular, it may be difficult to diagnose one or more valves controlling flow of purge gases from the fuel vapor canister to the intake passage upstream of the compressor. For example, it may be difficult to determine if a check valve positioned downstream of a canister purge valve and upstream of an ejector and intake passage, is stuck in an open position. If such a check valve is stuck in an open position, during natural aspiration (e.g., non-boosted) operation, intake air through the open path may be sucked into the engine. This unmetered air may cause the air-fuel ratio to decrease (and become leaner than desired), thereby increasing NOx emissions. Specifically, the inventors have recognized that it may be difficult to diagnose a position of such a check valve during regular boosted or non-boosted (e.g., vacuum) modes without the aid of additional sensors. However, adding sensors for this diagnosis may increase engine costs and complicate engine control.

The inventors herein have recognized these issues, and have developed systems and methods to at least partially address the above issues. In one example, a method is provided, comprising storing fuel vapors from a fuel system, which supplies fuel to an engine, in a fuel vapor storage canister, coupling the canister to an air intake of the engine through a second path having a second check valve which prevents unmetered air from being drawn into an intake manifold of the engine, and diagnosing whether the second check valve is stuck open based on a temperature change of the canister.

As one example, the method may include controlling pressure in the second path via a pump positioned in a vent line between the fuel vapor canister and atmosphere, where diagnosing whether the second check valve is stuck open includes reducing pressure in the second path via the pump. In some examples, reducing pressure in the second path via the pump draws atmospheric air across the second check valve under conditions where the second check valve is stuck open. Furthermore, the method may include controlling a flow of fuel vapors from the fuel system to the fuel vapor storage canister via a fuel tank isolation valve, where the fuel tank isolation valve is in a closed configuration during reducing pressure in the second path via the pump to prevent fuel vapors from being drawn into the fuel vapor storage canister.

In such an example, the method may include indicating the second check valve is stuck open responsive to the temperature change at the fuel vapor canister decreasing to a canister temperature change threshold. The method may further include preventing positive pressure with respect to atmospheric pressure from being communicated to the fuel vapor canister under conditions of positive pressure in the intake manifold via a first check valve in a first path, where diagnosing whether the second check valve is stuck open includes an indication that the first check valve is not stuck open. The method may further include diagnosing whether the second check valve is stuck open responsive to an indication that the first path and the second path are free from undesired evaporative emissions. The method may further include diagnosing whether the second check valve is stuck open while the engine is not in operation.

In this way, the second check valve may be periodically diagnosed as to whether the second check valve is stuck open, where responsive to an indication that the second check valve is stuck open, mitigating actions may be taken to prevent undesired emissions.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
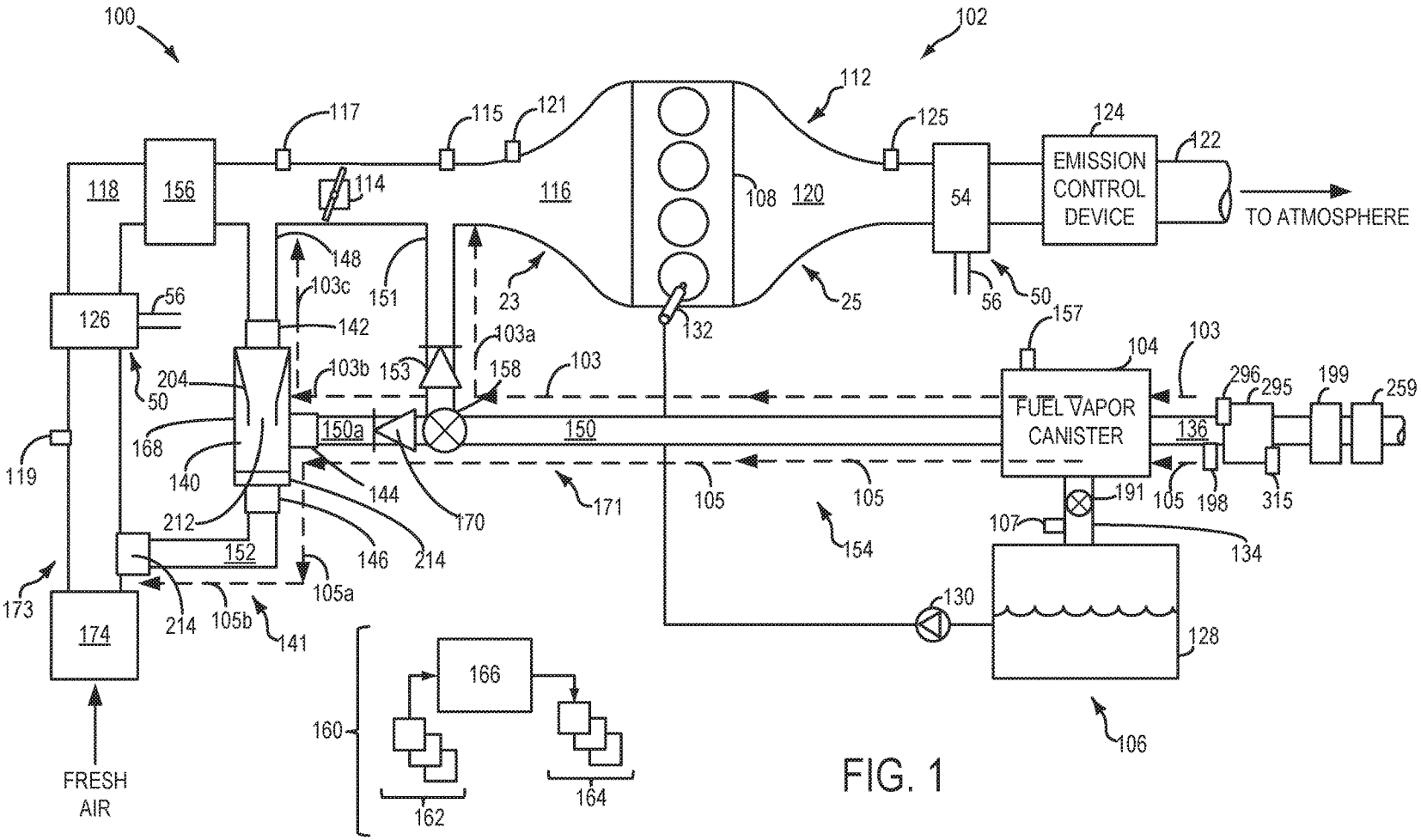
FIG. 1 shows a schematic diagram of a multi-path fuel vapor recovery system of a vehicle system.

The following description relates to systems and methods for diagnosing components in a vehicle fuel system and evaporative emissions system, such as fuel system and evaporative emissions system depicted at FIG. 1. More specifically, systems and methods are provided for determining whether undesired evaporative emissions are present in the fuel system and evaporative emissions system, whether a first check valve, whose function is to prevent positive pressure from being communicated to the evaporative emissions system and fuel system under boosted engine operation, is stuck open, and whether a second check valve, whose function is to prevent unmetered air from entering the engine under natural aspiration conditions (e.g. intake manifold vacuum), is stuck open. In some examples, the vehicle system may comprise a hybrid vehicle system, such as that depicted at FIG. 2. To diagnose the second check valve, an evaporative level check module (ELCM) positioned in a vent line stemming from a fuel vapor canister may be utilized, as will be described in more detail below. Such an ELCM may comprise a pump, an changeover valve, and a pressure sensor, and may be configurable in various conformation, depicted in FIGS. 3A-3D. For example, the ELCM pump may be utilized to either evacuate, or pressurize the vehicle fuel system and evaporative emissions system. An electronic circuit, such as that depicted in FIGS. 4A-4B, may be utilized to reverse the direction of the ELCM pump, for example.

Figure 5:
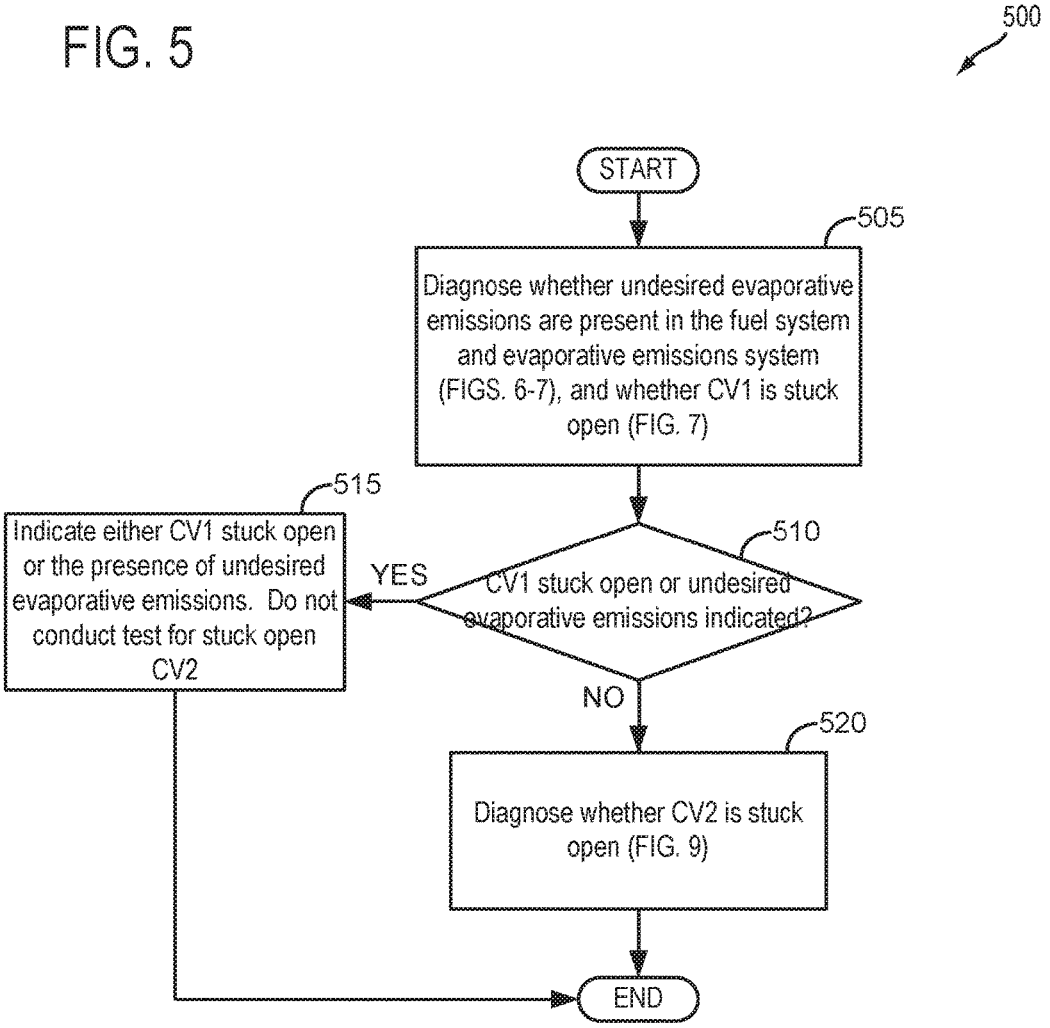
FIG. 5 shows a high-level flowchart for an example method for diagnosing whether a second check valve whose function is to prevent unmetered air from entering the engine is in a stuck open configuration.
Figure 7:
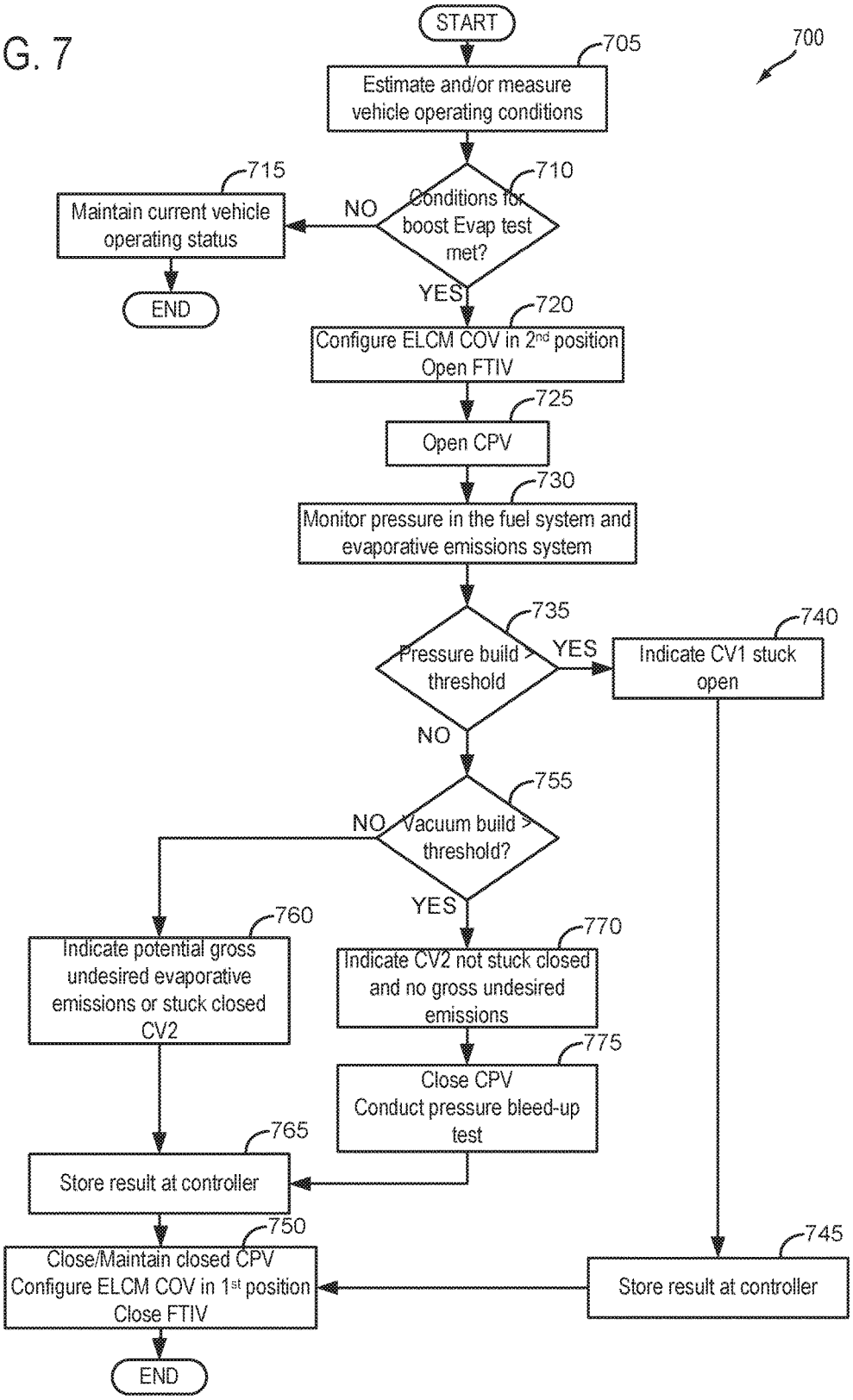
FIG. 7 shows a high-level flowchart for an example method for determining whether undesired evaporative emissions are present in the vehicle fuel system and evaporative emissions system when the engine is operating under boosted conditions, and for determining whether the first check valve is stuck in an open configuration.
Figure 8:
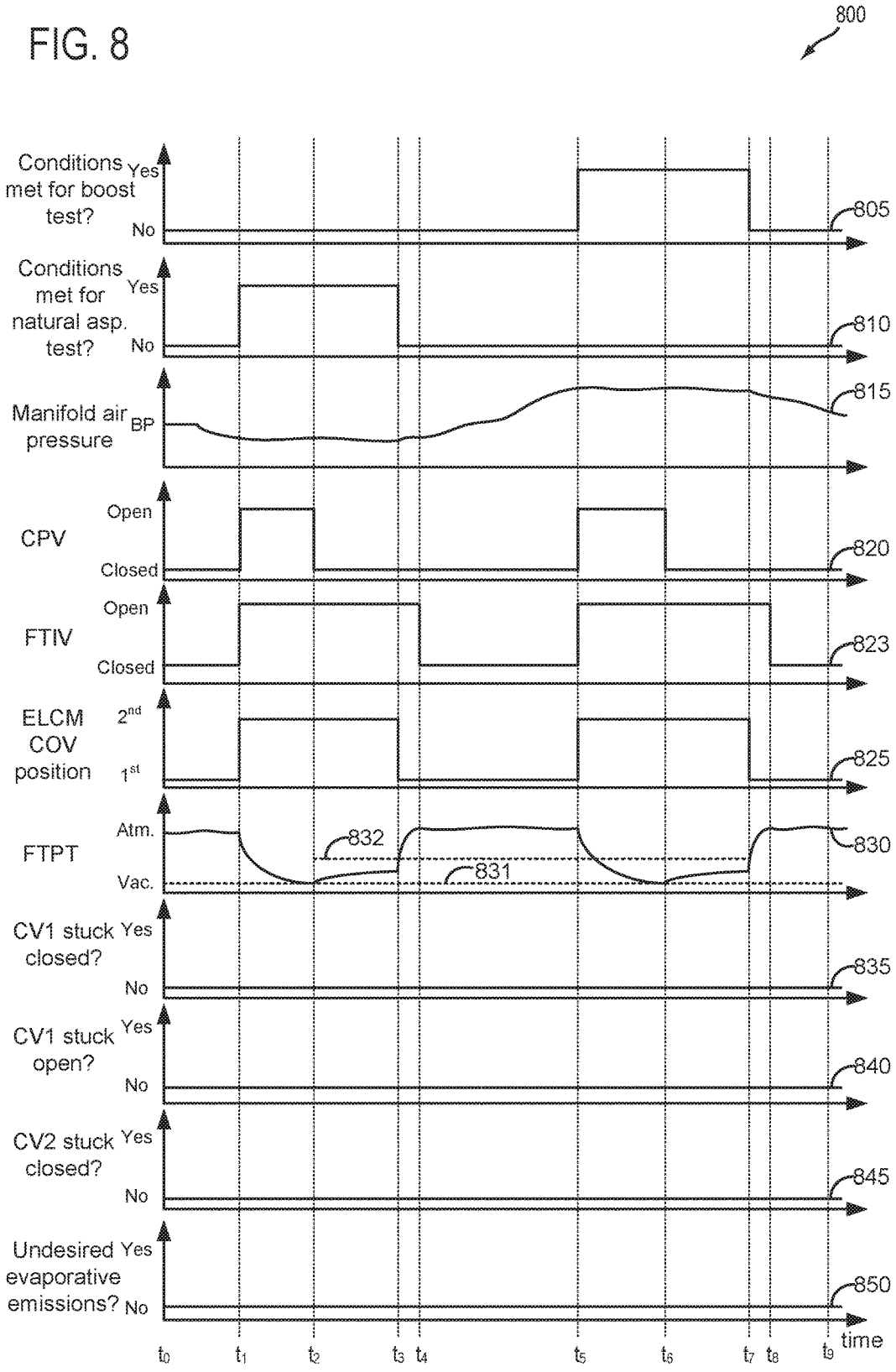
FIG. 8 shows an example timeline for diagnosing whether the first check valve is stuck open, and whether undesired evaporative emissions are present in the fuel system and evaporative emission system.

A high level flowchart for an example method for diagnosing the second check valve, is illustrated at FIG. 5. The second check valve may be diagnosed responsive to an indication that the fuel system and evaporative emissions system is free from undesired evaporative emissions, according to the method depicted at FIG. 6. Such a method may be conducted when the vehicle is operating under natural aspiration conditions. The second check valve further be diagnosed responsive to an indication that the first check valve is not in a stuck open configuration, according to the method depicted at FIG. 7. Furthermore, the method depicted at FIG. 7 illustrates a high level flowchart for conducting a test for undesired evaporative emissions in the fuel system and evaporative emissions system when the engine is operating under boosted conditions. An example timeline for determining whether undesired evaporative emissions are present in the vehicle fuel system and evaporative emissions system, and whether the first check valve is stuck open, is illustrated at FIG. 8.

Figure 9:
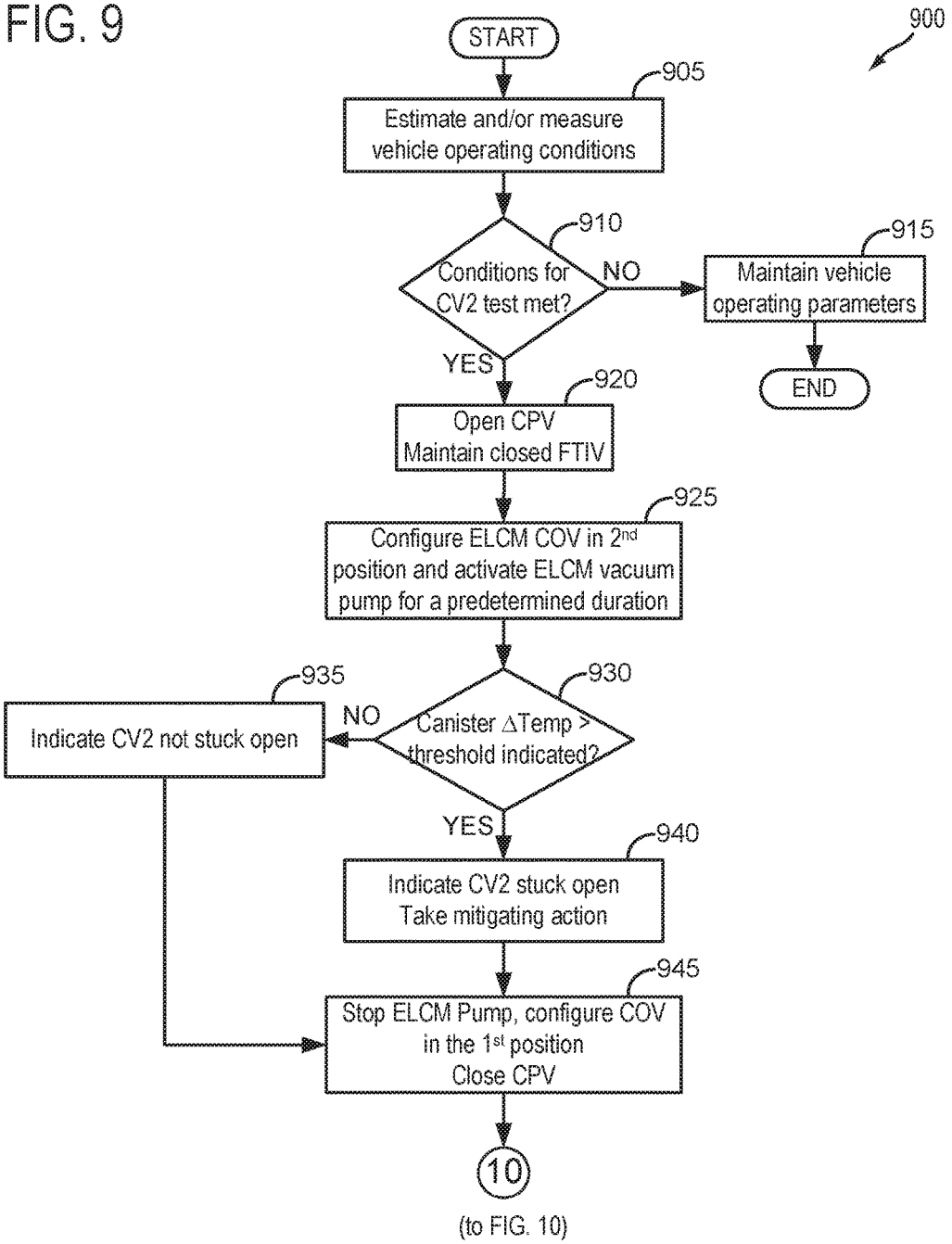
FIG. 9 shows a high-level flowchart for an example method for determining whether the second check valve is stuck in an open configuration.

Responsive to an indication that the fuel system and evaporative emissions system is free from undesired evaporative emissions, and further responsive to an indication that the first check valve is not stuck open, the second check valve may be diagnosed as to whether the second check valve is stuck open, according to the method depicted at FIG. 9. Such a method may include evacuating the evaporative emissions system via the ELCM pump, and monitoring the fuel vapor canister for a temperature change, as indicated by a canister temperature sensor positioned as close as possible to a purge line coupled to the fuel vapor canister. Subsequent to conducting the stuck-open second check valve test, the fuel vapor canister and evaporative emissions system may be purged of fuel vapors, according to the method depicted at FIG. 10. An example timeline for conducting the stuck-open second check valve diagnostic, and for conducting a fuel vapor canister purging operation, is illustrated at FIG. 11.

Turning to the figures, FIG. 1 shows a schematic depiction of a vehicle system 100. The vehicle system 100 includes an engine system 102 coupled to a fuel vapor recovery system (evaporative emissions control system) 154 and a fuel system 106. The engine system 102 may include an engine 112 having a plurality of cylinders 108. The engine 112 includes an engine intake 23 and an engine exhaust 25. The engine intake 23 includes a throttle 114 fluidly coupled to the engine intake manifold 116 via an intake passage 118. An air filter 174 is positioned upstream of throttle 114 in intake passage 118. The engine exhaust 25 includes an exhaust manifold 120 leading to an exhaust passage 122 that routes exhaust gas to the atmosphere. The engine exhaust 122 may include one or more emission control devices 124, which may be mounted in a close-coupled position in the exhaust. One or more emission control devices may include a three-way catalyst, lean NOx trap, diesel particulate filter, oxidation catalyst, etc. It will be appreciated that other components may be included in the vehicle system, such as a variety of valves and sensors, as further elaborated below.

Throttle 114 may be located in intake passage 118 downstream of a compressor 126 of a boosting device, such as turbocharger 50, or a supercharger. Compressor 126 of turbocharger 50 may be arranged between air filter 174 and throttle 114 in intake passage 118. Compressor 126 may be at least partially powered by exhaust turbine 54, arranged between exhaust manifold 120 and emission control device 124 in exhaust passage 122. Compressor 126 may be coupled to exhaust turbine 54 via shaft 56. Compressor 126 may be configured to draw in intake air at atmospheric air pressure into an air induction system (AIS) 173 and boost it to a higher pressure. Using the boosted intake air, a boosted engine operation may be performed.

An amount of boost may be controlled, at least in part, by controlling an amount of exhaust gas directed through exhaust turbine 54. In one example, when a larger amount of boost is requested, a larger amount of exhaust gases may be directed through the turbine. Alternatively, for example when a smaller amount of boost is requested, some or all of the exhaust gas may bypass turbine 54 via a turbine bypass passage as controlled by wastegate (not shown). An amount of boost may additionally or optionally be controlled by controlling an amount of intake air directed through compressor 126. Controller 166 may adjust an amount of intake air that is drawn through compressor 126 by adjusting the position of a compressor bypass valve (not shown). In one example, when a larger amount of boost is requested, a smaller amount of intake air may be directed through the compressor bypass passage.

Fuel system 106 may include a fuel tank 128 coupled to a fuel pump system 130. The fuel pump system 130 may include one or more pumps for pressurizing fuel delivered to fuel injectors 132 of engine 112. While only a single fuel injector 132 is shown, additional injectors may be provided for each cylinder. For example, engine 112 may be a direct injection gasoline engine and additional injectors may be provided for each cylinder. It will be appreciated that fuel system 106 may be a return-less fuel system, a return fuel system, or various other types of fuel system. In some examples, a fuel pump may be configured to draw the tank's liquid from the tank bottom. Vapors generated in fuel system 106 may be routed to fuel vapor recovery system (evaporative emissions control system) 154, described further below, via conduit 134, before being purged to the engine intake 23.

Fuel vapor recovery system 154 (herein referred to as evaporative emissions control system, or evaporative emissions system) includes a fuel vapor retaining device, depicted herein as fuel vapor canister 104. Canister 104 may be filled with an adsorbent capable of binding large quantities of vaporized HCs. In one example, the adsorbent used is activated charcoal. Canister 104 may receive fuel vapors from fuel tank 128 through conduit 134. While the depicted example shows a single canister, it will be appreciated that in alternate embodiments, a plurality of such canisters may be connected together. Canister 104 may communicate with the atmosphere through vent 136. In some examples, vent line 136 may include an air filter 259 disposed therein upstream of a canister 104. In some examples, a canister vent valve (not shown) may be located along vent 136, coupled between the fuel vapor canister and the atmosphere, and may adjust a flow of air and vapors between canister 104 and the atmosphere. However, in other examples, a canister vent valve may not be included. In one example, operation of canister vent valve 172 may be regulated by a canister vent solenoid (not shown). For example, based on whether the canister is to be purged or not, the canister vent valve may be opened or closed. In some examples, an evaporative level check monitor (ELCM) 295 may be disposed in vent 136 and may be configured to control venting and/or assist in detection of undesired evaporative emissions. Detailed description of ELCM 295 and how ELCM 295 may be selectively configured to control venting and/or assist in detection of undesired evaporative emissions is provided with regard to FIGS. 3A-3D. As an example, ELCM 295 may include a vacuum pump for applying negative pressure to the fuel system when administering a test for undesired evaporative emissions. In some embodiments, the vacuum pump may be configured to be reversible. In other words, the vacuum pump may be configured to apply either a negative pressure or a positive pressure on the evaporative emissions system 154 and fuel system 106. ELCM 295 may further include a reference orifice and a pressure sensor 296. A reference check may thus be performed whereby a vacuum may be drawn across the reference orifice, where the resulting vacuum level comprises a vacuum level indicative of an absence of undesired evaporative emissions. For example, following the reference check, the fuel system 106 and evaporative emissions system 154 may be evacuated by the ELCM vacuum pump. In the absence of undesired evaporative emissions, the vacuum may pull down to the reference check vacuum level. Alternatively, in the presence of undesired evaporative emissions, the vacuum may not pull down to the reference check vacuum level.

In other examples, which will be discussed in detail below, the ELCM may be utilized to draw a vacuum on the evaporative emissions system, in order to diagnose whether a second check valve 170 is stuck in an open configuration.

In some examples, evaporative emissions system 154 may further include a bleed canister 199. Hydrocarbons that desorb from canister 104 (also referred to as the "main canister") may be adsorbed within the bleed canister. Bleed canister 199 may include an adsorbent material that is different than the adsorbent material included in main canister 104. Alternatively, the adsorbent material in bleed canister 199 may be the same as that included in main canister 104.

A hydrocarbon sensor 198 may be present in evaporative emissions system 154 to indicate the concentration of hydrocarbons in vent 136. As illustrated, hydrocarbon sensor 198 is positioned between main canister 104 and bleed canister 199. A probe (e.g., sensing element) of hydrocarbon sensor 198 is exposed to and senses the hydrocarbon concentration of fluid flow in vent 136. Hydrocarbon sensor 198 may be used by the engine control system 160 for determining breakthrough of hydrocarbon vapors from main canister 104, in one example.

Furthermore, in some examples, one or more oxygen sensors 121 may be positioned in the engine intake 116, or coupled to the canister 104 (e.g., downstream of the canister), to provide an estimate of canister load. In still further examples, one or more temperature sensors 157 may be coupled to and/or within canister 104. As will be discussed in further detail below, as fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister, and may be used to estimate canister load.

In some examples, as will be discussed in further detail below, the one or more temperature sensors 157 may be utilized to indicate whether the second check valve 170 is in a stuck open configuration. For example, ELCM pump 295 may be utilized to draw a vacuum on evaporative emissions system 154, and temperature of the fuel vapor canister 104 may be monitored via the one or more temperature sensors 157. If a temperature decreases greater than a predetermined threshold is indicated, then it may be determined that the second check valve 170 is stuck in an open configuration.

Conduit 134 may optionally include a fuel tank isolation valve 191. Among other functions, fuel tank isolation valve 191 may allow the fuel vapor canister 104 to be maintained at a low pressure or vacuum without increasing the fuel evaporation rate from the tank (which would otherwise occur if the fuel tank pressure were lowered). The fuel tank 128 may hold a plurality of fuel blends, including fuel with a range of alcohol concentrations, such as various gasoline-ethanol blends, including E10, E85, gasoline, etc., and combinations thereof.

Fuel vapor recovery system 154 may include a dual path purge system 171. Purge system 171 is coupled to canister 104 via a conduit 150. Conduit 150 may include a canister purge valve (CPV) 158 disposed therein. Specifically, CPV 158 may regulate the flow of vapors along duct 150. The quantity and rate of vapors released by CPV 158 may be determined by the duty cycle of an associated CPV solenoid (not shown). In one example, the duty cycle of the CPV solenoid may be determined by controller 166 responsive to engine operating conditions, including, for example, an air-fuel ratio. By commanding the CPV to be closed, the controller may seal the fuel vapor canister from the fuel vapor purging system, such that no vapors are purged via the fuel vapor purging system. In contrast, by commanding the CPV to be open, the controller may enable the fuel vapor purging system to purge vapors from the fuel vapor canister.

Fuel vapor canister 104 operates to store vaporized hydrocarbons (HCs) from fuel system 106. Under some operating conditions, such as during refueling, fuel vapors present in the fuel tank may be displaced when liquid is added to the tank. The displaced air and/or fuel vapors may be routed from the fuel tank 128 to the fuel vapor canister 104, and then to the atmosphere through vent 136. In this way, an increased amount of vaporized HCs may be stored in fuel vapor canister 104. During a later engine operation, the stored vapors may be released back into the incoming air charge via fuel vapor purging system 171.

Conduit 150 is coupled to an ejector 140 in an ejector system 141 and includes a second check valve (CV2) 170 disposed therein, in conduit 150*a*, between ejector 140 and CPV 158. Second check valve (CV2) 170 may prevent intake air from flowing through from the ejector into conduit 150*a* and conduit 150, while allowing flow of air and fuel vapors from conduit 150 into ejector 140. CV2 170 may be a vacuum-actuated check valve, for example, that opens responsive to vacuum derived from ejector 140.

A conduit 151 couples conduit 150 to intake 23 at a position within conduit 150 between check valve 170 and CPV 158 and at a position in intake 23 downstream of throttle 114. For example, conduit 151 may be used to direct fuel vapors from canister 104 to intake 23 using vacuum generated in intake manifold 116 during a purge event. Conduit 151 may include a first check valve (CV1) 153 disposed therein. First check valve (CV1) 153 may prevent intake air from flowing through from intake manifold 116 into conduit 150, while allowing flow of fluid and fuel vapors from conduit 150 into intake manifold 116 via conduit 151 during a canister purging event. CV1 may be a vacuum actuated check valve, for example, that opens responsive to vacuum derived from intake manifold 116.

Conduit 148 may be coupled to ejector 140 at a first port or inlet 142. Ejector 140 includes a second port 144 or inlet coupling ejector 140 to conduit 150*a* and conduit 150. Ejector 140 is coupled to intake 23 at a position upstream of throttle 114 and downstream of compressor 126 via a conduit 148. During boost conditions, conduit 148 may direct compressed air in intake conduit 118 downstream of compressor 126 into ejector 140 via port 142.

Ejector 140 may also be coupled to intake conduit 118 at a position upstream of compressor 126 via a shut-off valve 214. Shut-off valve 214 is hard-mounted directly to air induction system 173 along conduit 118 at a position between air filter 174 and compressor 126. For example, shut-off valve 214 may be coupled to an existing AIS nipple or other orifice, e.g., an existing SAE male quick connect port, in AIS 173. Hard-mounting may include a direct mounting that is inflexible. For example, an inflexible hard mount could be accomplished through a multitude of methods including spin welding, laser bonding, or adhesive. Shut-off valve 214 is coupled to a third port 146 or outlet of ejector 140. Shut-off valve 214 is configured to close in response to undesired emissions detected downstream of outlet 146 of ejector 140. As shown in FIG. 1, in some examples, a conduit or hose 152 may couple the third port 146 or outlet of ejector 140 to shut-off valve 214. In this example, if a disconnection of shut-off valve 214 with AIS 173 is detected, then shut-off valve 214 may close so air flow from the engine intake downstream of the compressor through the converging orifice in the ejector is discontinued. However, in other examples, shut-off valve may be integrated with ejector 140 and directly coupled thereto.

Ejector 140 includes a housing 168 coupled to ports 146, 144, and 142. In one example, only the three ports 146, 144, and 142 are included in ejector 140. Ejector 140 may include various check valves disposed therein. For example, in some examples, ejector 140 may include a check valve positioned adjacent to each port in ejector 140 so that unidirectional flow of fluid or air is present at each port. For example, air from intake conduit 118 downstream of compressor 126 may be directed into ejector 140 via inlet port 142 and may flow through the ejector and exit the ejector at outlet port 146 before being directed into intake conduit 118 at a position upstream of compressor 126. This flow of air through the ejector may create a vacuum due to the Venturi effect at inlet port 144 so that vacuum is provided to conduit 150*a* and conduit 150 via port 144 during boosted operating conditions. In particular, a low pressure region is created adjacent to inlet port 144 which may be used to draw purge vapors from the canister into ejector 140.

Ejector 140 includes a nozzle 204 comprising an orifice which converges in a direction from inlet 142 toward suction inlet 144 so that when air flows through ejector 140 in a direction from port 142 towards port 146, a vacuum is created at port 144 due to the Venturi effect. This vacuum may be used to assist in fuel vapor purging during certain conditions, e.g., during boosted engine conditions. In one example, ejector 140 is a passive component. That is, ejector 140 is designed to provide vacuum to the fuel vapor purge system via conduit 150*a* and conduit 150 to assist in purging under various conditions, without being actively controlled. Thus, whereas CPV 158 and throttle 114 may be controlled via controller 166, for example, ejector 140 may be neither controlled via controller 166 nor subject to any other active control. In another example, the ejector may be actively controlled with a variable geometry to adjust an amount of vacuum provided by the ejector to the fuel vapor recovery system via conduit 150*a* and conduit 150.

During select engine and/or vehicle operating conditions, such as after an emission control device light-off temperature has been attained (e.g., a threshold temperature reached after warming up from ambient temperature) and with the engine running, the controller 166 may control an ELCM 295 changeover valve (COV) 315 (see FIGS. 3A-3D for detailed description) to enable fuel vapor canister 104 to be fluidically coupled to atmosphere. For example, ELCM COV 315 may be configured in a first position, where the first position includes the fuel vapor canister 104 fluidically coupled to atmosphere, except during pressure tests performed on the system (described in further detail below). At the same time, controller 12 may adjust the duty cycle of the CPV solenoid (not shown) and open CPV 158. Pressures within fuel vapor purging system 171 may then draw fresh air through vent 136, fuel vapor canister 104, and CPV 158 such that fuel vapors flow into conduit 150.

The operation of ejector 140 within fuel vapor purging system 171 during vacuum conditions will now be described. The vacuum conditions may include intake manifold vacuum conditions. For example, intake manifold vacuum conditions may be present during an engine idle condition, with manifold pressure below atmospheric pressure by a threshold amount. This vacuum in the intake system 23 may draw fuel vapor from the canister through conduits 150 and 151 into intake manifold 116, as represented by dashed line(s) 103 and 103*a*. Further, at least a portion of the fuel vapors may flow from conduit 150 into ejector 140 via port 144 via dashed line(s) 103, 103*b*, and 103*c*. Upon entering the ejector via port 144, the fuel vapors may flow through nozzle 204 toward port 142. Specifically, the intake manifold vacuum causes the fuel vapors to flow through orifice 212. Because the diameter of the area within the nozzle gradually increases in a direction from port 144 towards port 142, the fuel vapors flowing through the nozzle in this direction diffuse, which raises the pressure of the fuel vapors. After passing through the nozzle, the fuel vapors exit ejector 140 through first port 142 and flow through duct 148 to intake passage 118 and then to intake manifold 116, indicated by dashed line 103*c*.

Next, the operation of ejector 140 within fuel vapor purging system 171 during boost conditions will be described. The boost conditions may include conditions during which the compressor is in operation. For example, the boost conditions may include one or more of a high engine load condition and a super-atmospheric intake condition, with intake manifold pressure greater than atmospheric pressure by a threshold amount.

Fresh air enters intake passage 118 at air filter 174. During boost conditions, compressor 126 pressurizes the air in intake passage 118, such that intake manifold pressure is positive. Pressure in intake passage 118 upstream of compressor 126 is lower than intake manifold pressure during operation of compressor 126, and this pressure differential induces a flow of fluid from intake conduit 118 through duct 148 and into ejector 140 via ejector inlet 142. This fluid may include a mixture of air and fuel, in some examples. After the fluid flows into the ejector via the port 142, it flows through the converging orifice 212 in nozzle 204 in a direction from port 142 towards outlet 146. Because the diameter of the nozzle gradually decreases in a direction of this flow, a low pressure zone is created in a region of orifice 212 adjacent to suction inlet 144. The pressure in this low pressure zone may be lower than a pressure in duct 150*a* and 150. When present, this pressure differential provides a vacuum to conduit 150 to draw fuel vapor from canister 104, as indicated via dashed line(s) 105. This pressure differential may further induce flow of fuel vapors from the fuel vapor canister, through the CPV, and into port 144 of ejector 140. Upon entering the ejector, the fuel vapors may be drawn along with the fluid from the intake manifold out of the ejector via outlet port 146 and into intake 118 at a position upstream of compressor 126, as indicated via dashed lines 105*a* and 105*b*. Operation of compressor 126 then draws the fluid and fuel vapors from ejector 140 into intake passage 118 and through the compressor. After being compressed by compressor 126, the fluid and fuel vapors flow through charge air cooler 156, for delivery to intake manifold 116 via throttle 114.

Thus, herein, it may be understood that the fuel vapor canister may be coupled to an air intake of the engine through a first path having a first check valve 153, where the first path may include conduits 150 and 151. Furthermore, it may be understood that the fuel vapor canister may be coupled to an air intake of the engine through a second path having a second check valve 170. The second path may include conduits 150, and 150*a*. The second path may further include conduits 152, 118, and 148.

Vehicle system 100 may further include a control system 160. Control system 160 is shown receiving information from a plurality of sensors 162 (various examples of which are described herein) and sending control signals to a plurality of actuators 164 (various examples of which are described herein). As one example, sensors 162 may include an exhaust gas sensor 125 (located in exhaust manifold 120) and various temperature and/or pressure sensors arranged in intake system 23. For example, a pressure or airflow sensor 115 in intake conduit 118 downstream of throttle 114, a pressure or air flow sensor 117 in intake conduit 118 between compressor 126 and throttle 114, and a pressure or air flow sensor 119 in intake conduit 118 upstream of compressor 126. In some examples, pressure sensor 119 may comprise a dedicated barometric pressure sensor. Other sensors such as additional pressure, temperature, air/fuel ratio, and composition sensors may be coupled to various locations in the vehicle system 100. As another example, actuators 164 may include fuel injectors 132, throttle 114, compressor 126, a fuel pump of pump system 130, etc. The control system 160 may include an electronic controller 166. The controller may receive input data from the various sensors, process the input data, and trigger the actuators in response to the processed input data based on instruction or code programmed therein corresponding to one or more routines.

Diagnostic tests may be periodically performed on the evaporative emissions control system 154 and fuel system 106 in order to indicate the presence or absence of undesired evaporative emissions. In one example, under natural aspiration conditions (e.g. intake manifold vacuum conditions), ELCM COV 315 may be configured in a second position (e.g. closed) to seal the fuel vapor canister 104 from atmosphere, and CPV 158 may be commanded open. By commanding ELCM COV 315 to the second position and commanding open CPV 158 during natural aspiration conditions, the evaporative emissions control system 154 and fuel system 106 may be evacuated (as indicated via dashed lines 103, and 103*a*) in order to ascertain the presence or absence of undesired evaporative emissions, by monitoring pressure in the fuel system and evaporative emissions control system. Pressure in the fuel system and evaporative emissions control system may be monitored, for example, via a pressure sensor 107. In some examples pressure sensor 107 may comprise a fuel tank pressure transducer (FTPT). If a threshold vacuum (e.g. negative pressure threshold with respect to atmospheric pressure) is reached during evacuating the evaporative emissions control system 154 and fuel system 106, an absence of gross undesired evaporative emissions may be indicated. Furthermore, if the threshold vacuum is reached, then it may be indicated that the first check valve (CV1) 153 is not stuck closed or substantially closed, as in a case where CV1 153 is stuck closed, pressure sensor 107 may not indicate pressure changes.

In another example, under boost conditions (e.g. intake manifold pressure greater than barometric pressure by a predetermined threshold), again the ELCM COV 315 may be commanded to the second (e.g. closed) position, and the CPV 158 may be commanded open. By commanding closed the CVV 172 and commanding open the CPV 158 during boost conditions, the evaporative emissions control system 154 and fuel system 106 may be evacuated (as indicated via dashed lines 105) in order to ascertain the presence or absence of undesired evaporative emissions. As discussed above, pressure in the fuel system and evaporative emissions control system may be monitored via, for example, pressure sensor 107. If a threshold vacuum (e.g., negative pressure threshold with respect to atmospheric pressure) is reached during evacuating the evaporative emissions control system 154 and fuel system 106, an absence of gross undesired evaporative emissions may be indicated. Furthermore, if the threshold vacuum is reached, then it may be indicated that the second check valve (CV2) 170 is not stuck closed or substantially closed, as in a case where CV2 170 is stuck closed, pressure sensor 107 may not indicate pressure changes.

Figure 2:
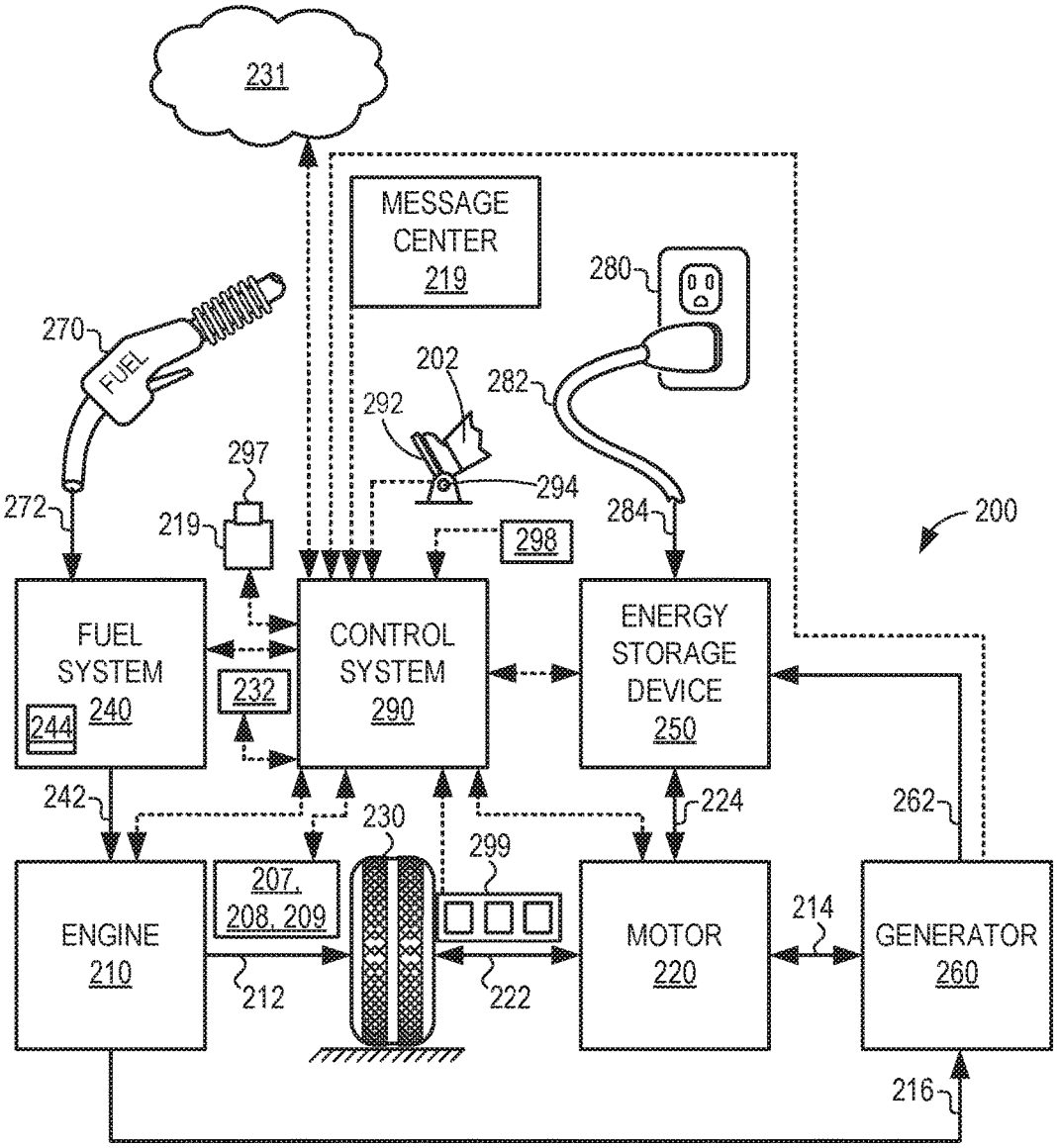
FIG. 2 schematically shows an example vehicle propulsion system.

FIG. 2 illustrates an example vehicle propulsion system 200. It may be understood that vehicle propulsion system 200 may comprise the same vehicle propulsion system as vehicle propulsions system 100 depicted at FIG. 1. Vehicle propulsion system 200 includes a fuel burning engine 210 and a motor 220. It may be understood that engine 210 may be the same as engine 112 depicted above at FIG. 1. As a non-limiting example, engine 210 comprises an internal combustion engine and motor 220 comprises an electric motor. Motor 220 may be configured to utilize or consume a different energy source than engine 210. For example, engine 210 may consume a liquid fuel (e.g., gasoline) to produce an engine output while motor 220 may consume electrical energy to produce a motor output. As such, a vehicle with propulsion system 200 may be referred to as a hybrid electric vehicle (HEV).

Vehicle propulsion system 200 may utilize a variety of different operational modes depending on operating conditions encountered by the vehicle propulsion system. Some of these modes may enable engine 210 to be maintained in an off state (i.e., set to a deactivated state) where combustion of fuel at the engine is discontinued. For example, under select operating conditions, motor 220 may propel the vehicle via drive wheel 230 as indicated by arrow 222 while engine 210 is deactivated.

During other operating conditions, engine 210 may be set to a deactivated state (as described above) while motor 220 may be operated to charge energy storage device 250. For example, motor 220 may receive wheel torque from drive wheel 230 as indicated by arrow 222 where the motor may convert the kinetic energy of the vehicle to electrical energy for storage at energy storage device 250 as indicated by arrow 224. This operation may be referred to as regenerative braking of the vehicle. Thus, motor 220 can provide a generator function in some examples. However, in other examples, generator 260 may instead receive wheel torque from drive wheel 230, where the generator may convert the kinetic energy of the vehicle to electrical energy for storage at energy storage device 250 as indicated by arrow 262.

During still other operating conditions, engine 210 may be operated by combusting fuel received from fuel system 240 as indicated by arrow 242. It may be understood that fuel system 240 may comprise the same fuel system as fuel system 106 depicted above at FIG. 1. For example, engine 210 may be operated to propel the vehicle via drive wheel 230 as indicated by arrow 212 while motor 220 is deactivated. During other operating conditions, both engine 210 and motor 220 may each be operated to propel the vehicle via drive wheel 230 as indicated by arrows 212 and 222, respectively. A configuration where both the engine and the motor may selectively propel the vehicle may be referred to as a parallel type vehicle propulsion system. Note that in some examples, motor 220 may propel the vehicle via a first set of drive wheels and engine 210 may propel the vehicle via a second set of drive wheels.

In other examples, vehicle propulsion system 200 may be configured as a series type vehicle propulsion system, whereby the engine does not directly propel the drive wheels. Rather, engine 210 may be operated to power motor 220, which may in turn propel the vehicle via drive wheel 230 as indicated by arrow 222. For example, during select operating conditions, engine 210 may drive generator 260 as indicated by arrow 216, which may in turn supply electrical energy to one or more of motor 220 as indicated by arrow 214 or energy storage device 250 as indicated by arrow 262. As another example, engine 210 may be operated to drive motor 220 which may in turn provide a generator function to convert the engine output to electrical energy, where the electrical energy may be stored at energy storage device 250 for later use by the motor.

Fuel system 240 may include one or more fuel storage tanks 244 for storing fuel on-board the vehicle. It may be understood that fuel storage tanks 244 may comprise the same fuel storage tank as fuel tank 128 depicted at FIG. 1. For example, fuel tank 244 may store one or more liquid fuels, including but not limited to: gasoline, diesel, and alcohol fuels. In some examples, the fuel may be stored on-board the vehicle as a blend of two or more different fuels. For example, fuel tank 244 may be configured to store a blend of gasoline and ethanol (e.g., E10, E85, etc.) or a blend of gasoline and methanol (e.g., M10, M85, etc.), whereby these fuels or fuel blends may be delivered to engine 210 as indicated by arrow 242. Still other suitable fuels or fuel blends may be supplied to engine 210, where they may be combusted at the engine to produce an engine output. The engine output may be utilized to propel the vehicle as indicated by arrow 212 or to recharge energy storage device 250 via motor 220 or generator 260.

In some examples, energy storage device 250 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 290 may communicate with one or more of engine 210, motor 220, fuel system 240, energy storage device 250, and generator 260. It may be understood that control system 290 may comprise the same control system as control system 160, depicted above at FIG. 1. Control system 290 may receive sensory feedback information from one or more of engine 210, motor 220, fuel system 240, energy storage device 250, and generator 260. Further, control system 290 may send control signals to one or more of engine 210, motor 220, fuel system 240, energy storage device 250, and generator 260 responsive to this sensory feedback. Control system 290 may receive an indication of an operator requested output of the vehicle propulsion system from a vehicle operator 202. For example, control system 290 may receive sensory feedback from pedal position sensor 294 which communicates with pedal 292. Pedal 292 may refer schematically to a brake pedal and/or an accelerator pedal.

Energy storage device 250 may periodically receive electrical energy from a power source 280 residing external to the vehicle (e.g., not part of the vehicle) as indicated by arrow 284. As a non-limiting example, vehicle propulsion system 200 may be configured as a plug-in hybrid electric vehicle (HEV), whereby electrical energy may be supplied to energy storage device 250 from power source 280 via an electrical energy transmission cable 282. During a recharging operation of energy storage device 250 from power source 280, electrical transmission cable 282 may electrically couple energy storage device 250 and power source 280. While the vehicle propulsion system is operated to propel the vehicle, electrical transmission cable 282 may disconnected between power source 280 and energy storage device 250. Control system 290 may identify and/or control the amount of electrical energy stored at the energy storage device, which may be referred to as the state of charge (SOC).

In other examples, electrical transmission cable 282 may be omitted, where electrical energy may be received wirelessly at energy storage device 250 from power source 280. For example, energy storage device 250 may receive electrical energy from power source 280 via one or more of electromagnetic induction, radio waves, and electromagnetic resonance. As such, it should be appreciated that any suitable approach may be used for recharging energy storage device 250 from a power source that does not comprise part of the vehicle. In this way, motor 220 may propel the vehicle by utilizing an energy source other than the fuel utilized by engine 210.

Fuel system 240 may periodically receive fuel from a fuel source residing external to the vehicle. As a non-limiting example, vehicle propulsion system 200 may be refueled by receiving fuel via a fuel dispensing device 270 as indicated by arrow 272. In some examples, fuel tank 244 may be configured to store the fuel received from fuel dispensing device 270 until it is supplied to engine 210 for combustion. In some examples, control system 290 may receive an indication of the level of fuel stored at fuel tank 244 via a fuel level sensor. The level of fuel stored at fuel tank 244 (e.g., as identified by the fuel level sensor) may be communicated to the vehicle operator, for example, via a fuel gauge or indication in a vehicle instrument panel 219.

The vehicle propulsion system 200 may also include an ambient temperature/humidity sensor 298, and sensors dedicated to indicating the occupancy-state of the vehicle, for example seat load cells 207, door sensing technology 208, and onboard cameras 209. Vehicle propulsion system 200 may further include a roll stability control sensor, such as a lateral and/or longitudinal and/or yaw rate sensor(s) 299. The vehicle instrument panel 219 may include indicator light(s) and/or a text-based display in which messages are displayed to an operator. The vehicle instrument panel 219 may also include various input portions for receiving an operator input, such as buttons, touch screens, voice input/recognition, etc. For example, the vehicle instrument panel 219 may include a refueling button 297 which may be manually actuated or pressed by a vehicle operator to initiate refueling. For example, in response to the vehicle operator actuating refueling button 297, a fuel tank in the vehicle may be depressurized so that refueling may be performed (in an example where the vehicle includes a fuel tank isolation valve).

Control system 290 may be communicatively coupled to other vehicles or infrastructures using appropriate communications technology, as is known in the art. For example, control system 290 may be coupled to other vehicles or infrastructures via a wireless network 231, which may comprise Wi-Fi, Bluetooth, a type of cellular service, a wireless data transfer protocol, and so on. Control system 290 may broadcast (and receive) information regarding vehicle data, vehicle diagnostics, traffic conditions, vehicle location information, vehicle operating procedures, etc., via vehicle-to-vehicle (V2V), vehicle-to-infrastructure-to-vehicle (V2I2V), and/or vehicle-to-infrastructure (V2I) technology. The communication and the information exchanged between vehicles can be either direct between vehicles, or can be multi-hop. In some examples, longer range communications (e.g. WiMax) may be used in place of, or in conjunction with, V2V, or V2I2V, to extend the coverage area by a few miles. In still other examples, vehicle control system 290 may be communicatively coupled to other vehicles or infrastructures via a wireless network 231 and the internet (e.g. cloud), as is commonly known in the art.

Vehicle system 200 may also include an on-board navigation system 232 (for example, a Global Positioning System) that an operator of the vehicle may interact with. The navigation system 232 may include one or more location sensors for assisting in estimating vehicle speed, vehicle altitude, vehicle position/location, etc. This information may be used to infer engine operating parameters, such as local barometric pressure. As discussed above, control system 290 may further be configured to receive information via the internet or other communication networks. Information received from the GPS may be cross-referenced to information available via the internet to determine local weather conditions, local vehicle regulations, etc.

Figures 3A, 3B, 3C, 3D:
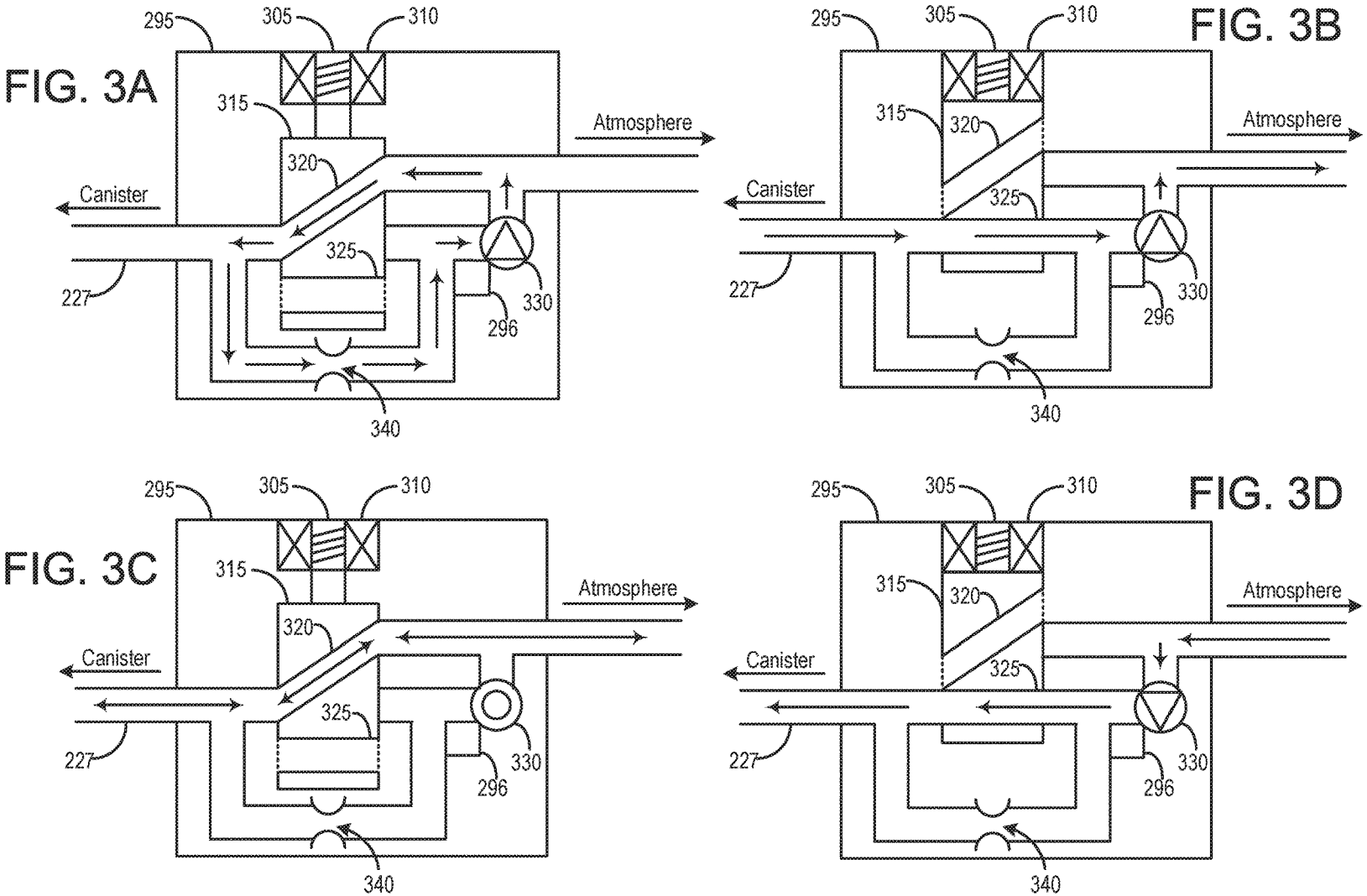
FIG. 3A shows a schematic depiction of an evaporative level check module (ELCM) in a configuration to perform a reference check.
FIG. 3B shows a schematic depiction of an ELCM in a configuration to evacuate a fuel system and evaporative emissions system.
FIG. 3C shows a schematic depiction of an ELCM in a configuration that couples a fuel vapor canister to atmosphere.
FIG. 3D shows a schematic depiction of an ELCM in a configuration to pressurize a fuel system and evaporative emissions system.

FIGS. 3A-3D show a schematic depiction of an example ELCM 295 in various conditions in accordance with the present disclosure. As shown in FIG. 2, ELCM 295 may be located along vent 136 between canister 104 and atmosphere. ELCM 295 includes a changeover valve (COV) 315, a pump 330, and a pressure sensor 296. Pump 330 may be a reversible pump, for example, a vane pump. COV 315 may be moveable between a first a second position. In the first position, as shown in FIGS. 3A and 3C, air may flow through ELCM 295 via first flow path 320. In the second position, as shown in FIGS. 3B and 3D, air may flow through ELCM 295 via second flow path 325. The position of COV 315 may be controlled by solenoid 310 via compression spring 305. ELCM 295 may also comprise reference orifice 340. Reference orifice 340 may have a diameter corresponding to the size of a threshold for undesired evaporative emissions to be tested, for example, 0.02". In either the first or second position, pressure sensor 296 may generate a pressure signal reflecting the pressure within ELCM 295. Operation of pump 330 and solenoid 310 may be controlled via signals received from controller 212.

As shown in FIG. 3A, COV 315 is in the first position, and pump 330 is activated in a first direction. Air flow through ELCM 295 in this configuration is represented by arrows. In this configuration, pump 330 may draw a vacuum on reference orifice 340, and pressure sensor 296 may record the vacuum level within ELCM 295. This reference check vacuum level reading may then become the threshold for the presence or absence of undesired evaporative emissions in a subsequent evaporative emissions test diagnostic.

As shown in FIG. 3B, COV 315 is in the second position, and pump 330 is activated in the first direction. This configuration allows pump 330 to draw a vacuum on fuel system 106 and evaporative emissions system 154. In examples where fuel system 218 includes a fuel tank isolation valve (e.g. 191), the fuel tank isolation valve (FTIV) may be opened to allow pump 330 to draw a vacuum on fuel tank 128. Air flow through ELCM 295 in this configuration is represented by arrows. In this configuration, as pump 330 pulls a vacuum on fuel system 106 and evaporative emissions system 154, the absence of undesired evaporative emissions in the system should allow for the vacuum level in ELCM 295 to reach or exceed the previously determined reference vacuum threshold. In the presence of undesired evaporative emissions larger than the reference orifice, the pump will not pull down to the reference check vacuum level.

As shown in FIG. 3C, COV 315 is in the first position, and pump 330 is de-activated. This configuration allows for air to freely flow between atmosphere and the canister. This configuration may be used during a canister purging operation, for example, and may additionally be used during vehicle operation when a purging operation is not being conducted, and when the vehicle is not in operation.

As shown in FIG. 3D, COV 315 is in the second position, and pump 330 is activated in a second direction, opposite from the first direction. In this configuration, pump 330 may pull air from atmosphere into fuel system 218 and evaporative emission system 251. In a configuration where FTIV 191 is open and CPV 158 is closed, air drawn by pump 330 may promote desorption of fuel vapor from canister 222, and further direct the desorbed fuel vapor into fuel tank 220. In this way, fuel vapor may be purged from the canister to the fuel tank, thereby decreasing the potential for bleed emissions.

Still further, while not explicitly illustrated, when the COV 315 is in the second position and pump 330 is off, the fuel system 106 and evaporative emissions system 154 may be understood to be sealed from atmosphere. Accordingly, the COV 315 when configured in the second position with pump 330 off, may function similar to a canister vent valve (not shown) when the canister vent valve is in a closed configuration.

Figure 4A:
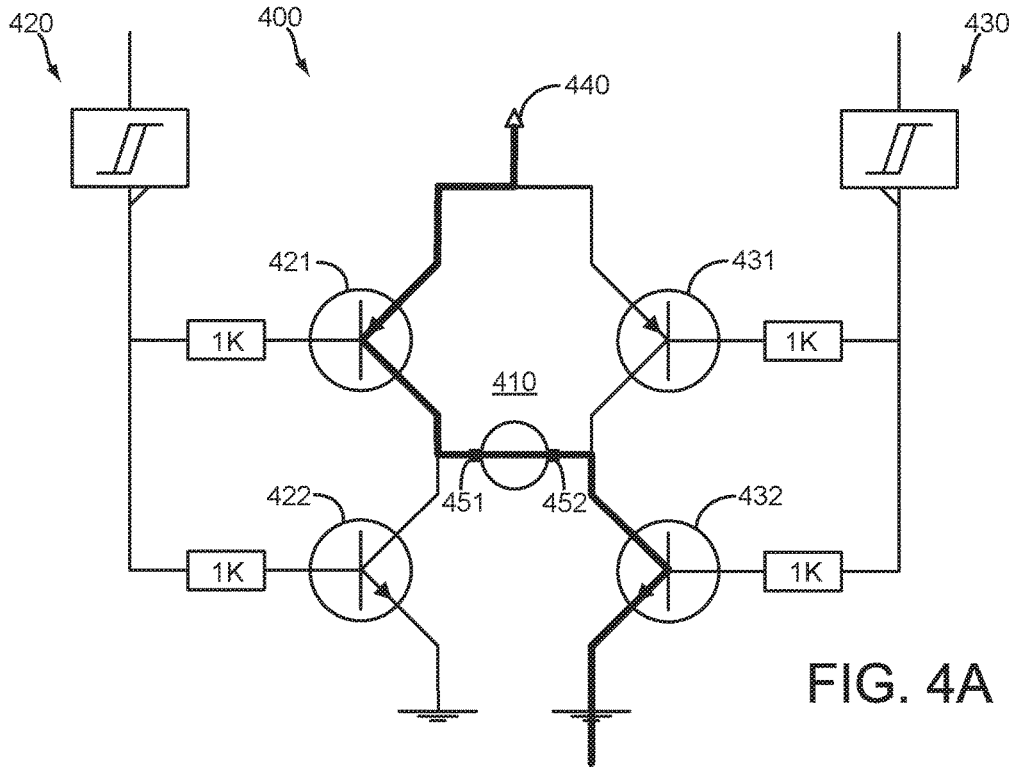
FIGS. 4A-4B show a schematic depiction of an electronic circuit configured to reverse the spin orientation of an electric motor.
Figure 4B:
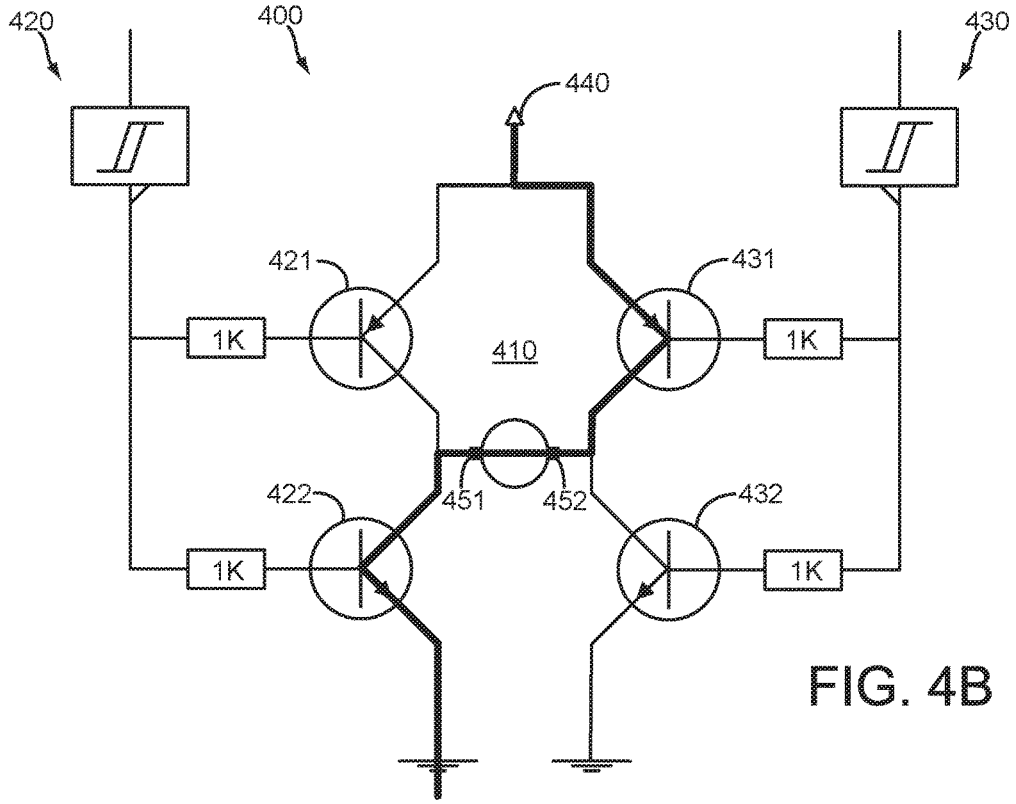

FIGS. 4A and 4B show an example circuit 400 that may be used for reversing pump motor of ELCM 295. Circuit 400 schematically depicts an H-Bridge circuit that may be used to run a motor 410 in a first (forward) direction and alternately in a second (reverse) direction. Circuit 400 comprises a first (LO) side 420 and a second (HI) side 430. Side 420 includes transistors 421 and 422, while side 430 includes transistors 431 and 432. Circuit 400 further includes a power source 440.

In FIG. 4A, transistors 421 and 432 are activated, while transistors 422 and 431 are off. In this confirmation, the left lead 451 of motor 410 is connected to power source 440, and the right lead 452 of motor 410 is connected to ground. In this way, motor 400 may run in a forward direction. For example, the forward direction. In some examples, the forward direction may comprise the ELCM 295 drawing vacuum on the fuel system and evaporative emissions system, such as depicted above at FIG. 3B.

In FIG. 4B, transistors 422 and 431 are activated, while transistors 421 and 432 are off. In this confirmation, the right lead 452 of motor 410 is connected to power source 440, and the left lead 451 of motor 410 is connected to ground. In this way, motor 400 may run in a reverse direction. In some examples, the reverse direction may comprise the ELCM 295 applying positive pressure with respect to atmospheric pressure the fuel system and evaporative emissions system, such as depicted above at FIG. 3D.

Thus, a system for a vehicle may comprise an engine operable under boosted and natural aspiration conditions, a fuel system including a fuel tank which supplies fuel to the engine, the fuel system selectively coupled to an evaporative emissions system via a fuel tank isolation valve. The system may further include a fuel vapor storage canister positioned in the evaporative emissions system, and an onboard pump positioned in a vent line between the fuel vapor storage canister and atmosphere, the pump including a changeover valve configurable in a first and a second position. The system may further include one or more temperature sensors positioned in the fuel vapor storage canister, a pressure sensor positioned in a conduit between the fuel system and evaporative emissions system, a canister purge valve positioned in a purge line downstream of the fuel vapor storage canister, a first check valve positioned between the canister purge valve and an intake manifold of the engine, and a second check valve positioned between the canister purge valve and an ejector system. The system may further include a controller storing instructions in non-transitory memory that, when executed, cause the controller to, in a first condition, indicate whether the first check valve is stuck open based on a monitored pressure change in the fuel system and evaporative emissions system during boosted engine operation, and in a second condition, indicate whether the second check valve is stuck open based on a monitored fuel vapor canister temperature change during an engine-off condition, where the second condition includes an indication that the first check valve is not stuck open.

For such a system, in the first condition, the controller may couple the fuel system to the evaporative emissions system by commanding open the fuel tank isolation valve, seal the fuel system and evaporative emissions system from atmosphere by commanding the changeover valve to the second position, command open the canister purge valve, monitor pressure in the fuel system and evaporative emissions system, and indicate that the first check valve is stuck open responsive to the monitored pressure in the fuel system and evaporative emissions system reaching a predetermined positive pressure threshold.

During the first condition, responsive to an indication that the first check valve is not stuck open and a vacuum build in the fuel system and evaporative emissions system reaching a vacuum build threshold due to the ejector system communicating vacuum to the fuel system and evaporative emissions system, the controller may command closed the canister purge valve, and indicate the fuel system and evaporative emissions system are free from undesired evaporative emissions responsive to pressure in the fuel system and evaporative emissions system remaining below a predetermined threshold pressure for a predetermined duration.

During natural aspiration conditions, where natural aspiration conditions include pressure in the intake manifold below atmospheric pressure, the controller may command open the fuel tank isolation valve, command the changeover valve to the second position, and command open the canister purge valve. Responsive to pressure in the fuel system and evaporative emissions system reaching a predetermined vacuum build threshold, the controller may command closed the canister purge valve, and indicate the fuel system and evaporative emissions system are free from undesired evaporative emissions responsive to pressure in the fuel system and evaporative emissions system remaining below a predetermined threshold pressure for a predetermined duration.

In some examples, the second condition may include an indication that the fuel system and evaporative emissions system are free from undesired evaporative emissions. Furthermore, in the second condition, the controller may command the changeover valve to the second position, command open the canister purge valve, command the onboard pump to draw a vacuum on the evaporative emissions system, and indicate the second check valve is stuck open responsive to a canister temperature decrease greater than a canister temperature change threshold.

Furthermore, in the second condition, the controller may command the onboard pump to apply a positive pressure with respect to atmosphere on the evaporative emissions system for a predetermined duration responsive to an indication of the second check valve being stuck open, during the engine off condition. The system may further include monitoring a fuel vapor level in the vent line via a hydrocarbon sensor positioned between the fuel vapor canister and the onboard pump, and, in the second condition, the controller may command the onboard pump to apply the positive pressure on the evaporative emissions system for the predetermined duration responsive to an indication of the second check valve being stuck open, and further responsive to an indication of the presence of fuel vapors in the vent line, during the engine-off condition.

Still further, the system may include, responsive to an indication of the second check valve being stuck open, and further responsive to an engine-on event, employing the controller to purge fuel vapors from the evaporative emissions system and fuel vapor canister under either boosted engine operation or natural aspiration conditions by commanding open the canister purge valve, to draw fresh air across the canister to desorb fuel vapors, where the desorbed fuel vapors are routed to the engine for combustion.

Turning to FIG. 5, a high level example method 500 for determining whether a second check valve (CV2) (e.g. 170) is stuck in an open configuration. More specifically, CV2 may be diagnosed responsive to an indication that the evaporative emissions system is free from undesired evaporative emissions, and further responsive to an indication that a first check valve (CV1) (e.g 153) is not stuck open. When conditions are indicated to be met for conducting the test for a stuck open CV2, an ELCM pump (e.g. 330) may be used to draw a vacuum on the evaporative emissions system, and a temperature change at a fuel vapor canister (e.g. 104) may be monitored to indicate whether the CV2 is stuck open.

Method 500 will be described with reference to the systems described herein and shown in FIGS. 1-4B, though it should be understood that similar methods may be applied to other systems without departing from the scope of this disclosure. Method 500 may be carried out by a controller, such as controller 166 in FIG. 1, and may be stored at the controller as executable instructions in non-transitory memory. Instructions for carrying out method 500 and the rest of the methods included herein may be executed by the controller based on instructions stored on a memory of the controller and in conjunction with signals received from sensors of the engine system, such as the sensors described above with reference to FIGS. 1-3D. The controller may employ fuel system and evaporative emissions system actuators, such as ELCM COV (e.g. 315), canister purge valve (CPV) (e.g. 158), ELCM pump (e.g. 330), fuel tank isolation valve (FTIV) (e.g. 191), etc., according to the methods depicted below.

FIG. 5 begins at 505 and may include diagnosing whether undesired evaporative emissions are present in the evaporative emissions system. Such a diagnosis may be achieved according to the methods depicted below at FIGS. 6-7. Furthermore, at 505, method 500 may include determining whether the CV1 is stuck in open configuration. Such a diagnosis may be achieved according to the method depicted below at FIG. 7.

Proceeding to 510, method 500 may include indicating whether the CV1 is stuck open, and whether undesired evaporative emissions are indicated in the evaporative emissions system. If, at 510, it is indicated that either the CV1 is stuck open, or that undesired evaporative emissions are present in the evaporative emissions system, method 500 may proceed to 515.

At 515, method 500 may include indicating that either the CV1 is stuck open, or that undesired evaporative emissions are present in the evaporative emissions system. Responsive to either undesired evaporative emissions being indicated in the evaporative emissions system, or responsive to an indication that the CV1 is stuck open, method 500 may include not conducting (e.g. aborting) a test for whether CV2 is stuck open. More specifically, as the test for whether CV2 is stuck open includes applying a vacuum on the evaporative emissions system via the ELCM pump, such a test may not be robust if undesired evaporative emissions are present in the evaporative emissions system, or if CV1 is stuck open. For example, responsive to a stuck open CV1 or the presence of undesired evaporative emissions, the ELCM pump may not be able to draw a sufficient vacuum on the evaporative emissions system to conduct a test for whether CV2 is stuck open. Method 500 may then end.

Alternatively, responsive to an indication that the CV1 is not stuck open, and further responsive to an indication of an absence of undesired evaporative emissions in the evaporative emissions system, method 500 may proceed to 520. At 520, method 500 may include diagnosing whether the CV2 is stuck in an open configuration. Such a diagnosis may be achieved according to the method depicted below at FIG. 9.

Figure 6:
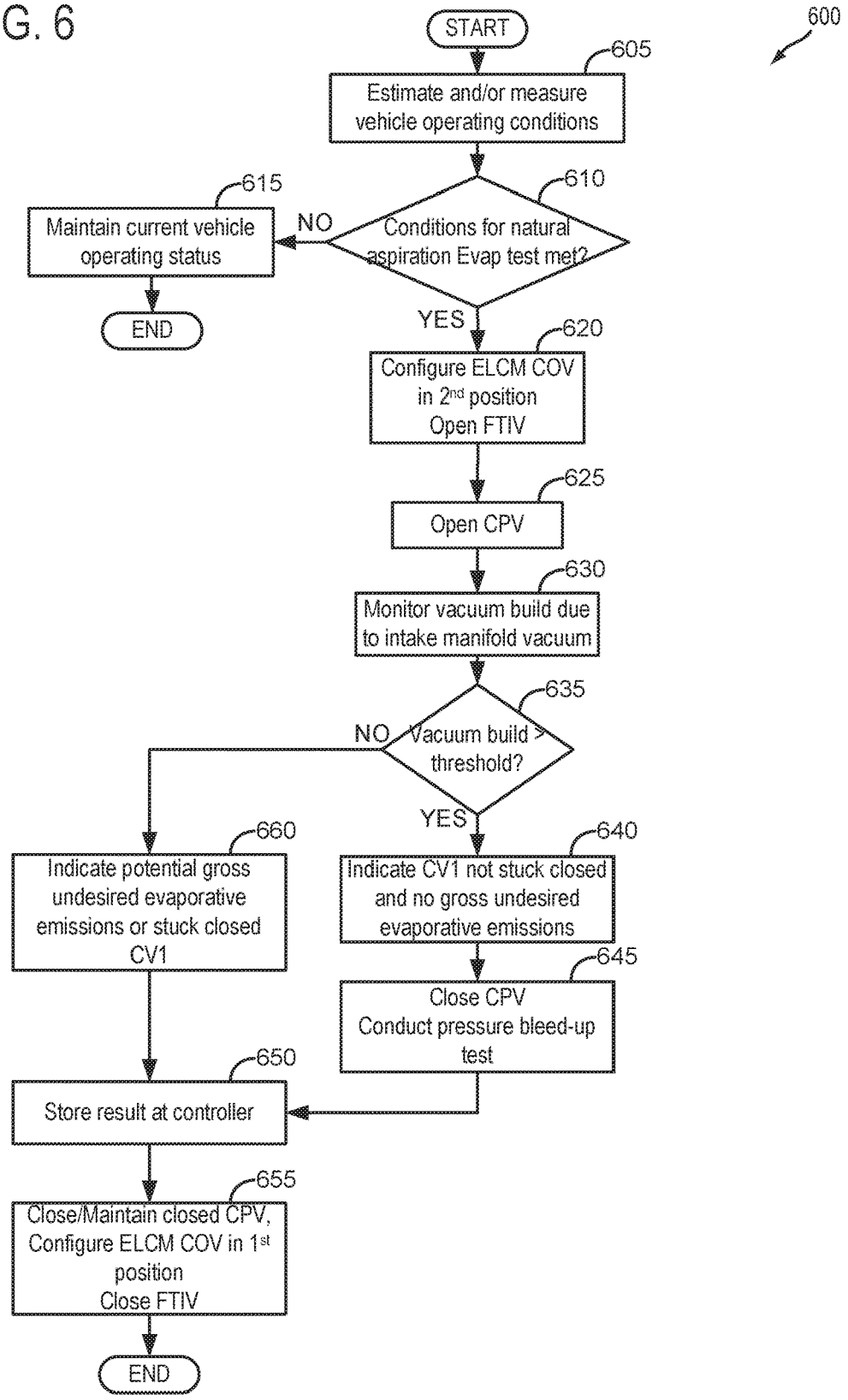
FIG. 6 shows a high-level flowchart for an example method for determining whether undesired evaporative emissions are present in a vehicle fuel system and evaporative emissions system when the engine is operating under natural aspiration conditions.

Turning now to FIG. 6, a flow chart for a high level example method 600 for performing an evaporative emissions test diagnostic procedure on an evaporative emissions control system (e.g., 154) and fuel system (e.g., 106), is shown. More specifically, method 600 may be used to conduct an evaporative emissions test diagnostic procedure responsive to an indication that conditions are met for an evaporative emissions test under natural aspiration (intake manifold vacuum) conditions. In this way, by conducting the evaporative emissions test under natural aspiration conditions, an absence of undesired evaporative emissions and an indication that a first check valve (CV1) (e.g., 153) is not stuck closed may be conclusively indicated responsive to a threshold vacuum being reached during conducting the evaporative emissions test diagnostic. Furthermore, responsive to an indication that the threshold vacuum is not reached during conducting the evaporative emissions test diagnostic, it may be indicated that either gross undesired emissions are present, or that CV1 is stuck closed. Whether the threshold vacuum is indicated to be reached or not, the results of the evaporative emissions test diagnostic procedure may be stored at the controller, as discussed in further detail below.

Method 600 will be described with reference to the systems described herein and shown in FIGS. 1-3D, though it should be understood that similar methods may be applied to other systems without departing from the scope of this disclosure. Method 600 may be carried out by a controller, such as controller 166 in FIG. 1, and may be stored at the controller as executable instructions in non-transitory memory. Instructions for carrying out method 600 and the rest of the methods included herein may be executed by the controller based on instructions stored on a memory of the controller and in conjunction with signals received from sensors of the engine system, such as the sensors described above with reference to FIGS. 1-2. The controller may employ fuel system and evaporative emissions system actuators, such as canister purge valve (CPV) (e.g., 158), ELCM changeover valve (COV) (e.g. 315), fuel tank isolation valve (FTIV) (e.g. 191), etc., according to the method below.

Method 600 begins at 605 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 610, method 600 may include indicating whether conditions for an evaporative emissions test under natural aspiration (intake manifold vacuum) are met. For example, conditions for an evaporative emissions test under natural aspiration may include an indication of manifold air pressure (MAP) less than barometric pressure (BP) by a predetermined threshold amount. In some examples, conditions being met at 610 may include MAP being less than BP by the predetermined threshold amount for a predetermined time duration. Conditions being met at 610 may in some examples further include an indication that an evaporative emission test diagnostic on the evaporative emissions control system and fuel system under natural aspiration conditions has not already been conducted during the current drive cycle. Conditions being met at 610 may in some examples further include an indication that a purge event is not in progress. Still further, conditions being met at 610 may in some examples include no prior indication of undesired evaporative emissions in the evaporative emissions system and fuel system, and no prior indication of CV1 (e.g., 153) being stuck closed.

If, at 610, conditions for an evaporative emissions test diagnostic procedure under natural aspiration are not indicated to be met, method 600 may proceed to 615. At 615, method 600 may include maintaining current vehicle operating status. For example, at 615, method 600 may include maintaining the CPV in its current configuration, maintaining the ELCM COV in its current configuration, maintaining the FTIV in its current configuration, etc. Furthermore, other engine system actuators such as throttle, fuel injectors, etc., may be maintained in their current status. Method 600 may then end.

Returning to 610, if it is indicated that conditions for an evaporative emissions test diagnostic procedure are met, method 600 may proceed to 620. At 620, method 600 may include commanding the ELCM COV to the second position. More specifically, a signal may be sent from the controller actuating the ELCM COV to the second position. For example, the ELCM COV in the second position is illustrated at FIG. 3B and FIG. 3D. Furthermore, at 620, method 600 may include maintaining the ELCM pump (e.g. 330) off. At 620, method 600 may further include commanding open (e.g. actuating open) the FTIV. With the ELCM COV configured in the second position with the ELCM pump off, and the FTIV open, it may be understood that the fuel system and evaporative emissions system may be sealed from atmosphere. While the FTIV is indicated to be commanded open at 620, in other examples, it may be understood that the FTIV may be maintained closed. For example, only the evaporative emissions system may be diagnosed for undesired evaporative emissions responsive to the FTIV being maintained closed at 620. In such an example, rather than relying on the fuel tank pressure transducer (FTPT) (e.g. 107), the ELCM pressure sensor (e.g. 296) may be utilized to monitor pressure in the evaporative emissions system. The FTIV may be maintained closed at 620 without departing from the scope of the present disclosure.

Proceeding to 625, method 600 may include commanding open (e.g. actuating open) the CPV. More specifically, the vehicle controller (e.g. 166) may send a signal to actuate open the CPV. By commanding the ELCM COV to the second position with the FTIV open, and commanding open the CPV, vacuum derived from the intake manifold under natural aspiration conditions may be applied to the evaporative emissions system (e.g., 154) and fuel system (e.g., 106). More specifically, by commanding the ELCM COV to the second position at step 620, the evaporative emissions system and fuel system may be sealed from atmosphere. By commanding open the CPV at 625, vacuum derived from the intake manifold may be applied to the sealed fuel system and evaporative emissions system.

Proceeding to 630, method 600 may include monitoring vacuum build in the fuel system and evaporative emissions system (or in some examples just the evaporative emissions system if the FTIV is maintained closed). For example, as discussed above, monitoring vacuum build (e.g., negative pressure with respect to atmospheric pressure) may include monitoring pressure via a pressure sensor (e.g., 107) (or via the ELCM pressure sensor under conditions where the FTIV is maintained closed), positioned in the fuel system and/or evaporative emissions system. Monitoring vacuum build at 630 may be conducted for a predetermined time duration, in some examples.

Proceeding to 635, method 600 may include indicating whether vacuum build as monitored by the pressure sensor during evacuating the fuel system and evaporative emissions system is greater than a predetermined threshold. The predetermined threshold may be in some examples be a function of atmospheric pressure. For example, the predetermined threshold may comprise a decreased vacuum level responsive to decreasing barometric pressure, and increased vacuum level responsive to increasing barometric pressure.

At 635, if it is indicated that vacuum build in the fuel system and evaporative emissions system (or just the evaporative emissions system under conditions where the FTIV is maintained closed) has reached the predetermined threshold, method 600 may proceed to 640. At 640, method 600 may include indicating that CV1 (e.g., 153) is not stuck closed or substantially closed. If CV1 were stuck closed, then the pressure sensor (e.g., 107) would not have registered a change in pressure during evacuating the fuel system and evaporative emissions system. Furthermore, at 640, it may be indicated that there are no gross undesired evaporative emissions stemming from the fuel system and evaporative emissions system.

Proceeding to 645, method 600 may include closing the CPV to isolate the fuel system and evaporative emissions system from atmosphere and from engine intake, and monitoring a pressure bleed-up in the fuel system and evaporative emissions system. Again, pressure may be monitored by a pressure sensor (e.g., 107). Pressure may be monitored for a predetermined duration, in some examples. If pressure in the fuel system and evaporative emissions system reaches a predetermined threshold pressure, or if a rate of pressure bleed-up exceeds a predetermined pressure bleed-up rate, then non-gross undesired evaporative emissions may be indicated. However, if, during the predetermined duration, pressure does not reach the predetermined threshold pressure, or if the rate of pressure bleed-up does not exceed the predetermined pressure bleed-up rate, then it may be indicated that non-gross undesired evaporative emissions are not present. As such, step 645 comprises testing for the presence or absence of non-gross undesired evaporative emissions by comparing a pressure change in the fuel system or evaporative emission system to a reference pressure change after evacuating the fuel system and evaporative emissions system.

Proceeding to step 650, method 600 may include storing the results of the evaporative emissions test diagnostic procedure at the controller. As will be discussed in further detail below with regard to FIG. 7 and FIG. 9, the results of the evaporative emissions test diagnostic procedure conducted according to method 600 may in some examples be utilized in conjunction with results of an evaporative emissions test diagnostic procedure conducted under boost conditions (see FIG. 7), in order to indicate that conditions are met for conducting a test diagnostic for whether the CV2 (e.g. 170) is stuck open, as discussed above and which will be further discussed below.

Continuing to 655, method 600 may include maintaining closed the CPV, and commanding ELCM COV (e.g. 315) to the first position. By maintaining closed the CPV, the fuel system and evaporative emissions system may be sealed from engine intake (and from the ejector). Furthermore, by commanding the ELCM COV to the first position, pressure in the fuel system and evaporative emissions system may return to atmospheric pressure. In an example where the FTIV was open to conduct the test for undesired evaporative emissions, the FTIV may be maintained open until it is indicated that the evaporative emissions system and fuel system is at atmospheric pressure, and may then be commanded (e.g. actuated) closed. Method 600 may then end.

Returning to 635, if it is indicated that vacuum build in the fuel system and evaporative emissions system did not reach the predetermined threshold vacuum, method 600 may proceed to 660. At 660, method 600 may include indicating that either CV1 is stuck closed, or that gross undesired evaporative emissions are present in the fuel system and evaporative emissions system. In other words, the vacuum build may have been prevented from reaching the predetermined vacuum threshold due to the CV1 being stuck closed, or due to gross undesired evaporative emissions. Accordingly, a conclusive determination as to the source of the failure to reach the predetermined threshold vacuum may not be indicated at 660. Instead, method 600 may proceed to 650. At 650, method 600 may include storing the results of the evaporative emissions test diagnostic at the controller. As discussed above, and which will be discussed in further detail below with regard to FIG. 7, the results of the evaporative emissions test diagnostic procedure conducted according to method 600 may in some examples be utilized in conjunction with results of an evaporative emissions test diagnostic procedure conducted under boost conditions (see FIG. 7), in order to conclusively determine why the threshold vacuum was not reached during evacuating the evaporative emissions system and fuel system according to method 600. Briefly, responsive to the predetermined threshold vacuum not being reached at 635, a test under boosted engine operation (FIG. 7) may be conducted to indicate whether undesired evaporative emissions are present in the fuel system and evaporative emissions system, as will be discussed in further detail below. In some examples, responsive to the test under boosted operation indicating the absence of undesired evaporative emissions, yet where the vacuum build at 635 failed to reach the vacuum build threshold, it may be indicated that the CV1 is stuck closed.

Continuing to 655, method 600 may include commanding closed (e.g. actuating closed) the CPV, and commanding the ELCM COV to the first position (e.g. actuating the ELCM COV to the first position). As described above, by commanding closed the CPV, the fuel system and evaporative emissions system may be sealed from engine intake (and from the ejector). Furthermore, by commanding the ELCM COV to the first position, pressure in the evaporative emissions system (and in some examples the fuel system) may be returned to atmospheric pressure. In an example where the vehicle system includes an FTIV, the FTIV may be maintained open until it is indicated that fuel system pressure is at atmospheric pressure, at which point the FTIV may be commanded closed. Method 600 may then end.

Turning to FIG. 7, a flow chart for a high level example method 700 for performing an evaporative emissions test diagnostic procedure on an evaporative emissions control system (e.g., 154) and fuel system (e.g., 106), is shown. More specifically, method 700 may be used to conduct an evaporative emissions test diagnostic procedure responsive to an indication that conditions are met for an evaporative emissions test under boost conditions. Conducting such an evaporative emissions test diagnostic procedure may include the evaporative emission system and fuel system being coupled to a compressor inlet through an orifice having an inlet pressure reduced by a venturing effect, thus enabling evacuation of the fuel system and evaporative emissions system under boost conditions. In this way, by conducting the evaporative emissions test under boost conditions, an absence of undesired evaporative emissions and an indication that a second check valve (CV2) (e.g., 170) is not stuck closed may be conclusively indicated responsive to a threshold vacuum being reached during conducting the evaporative emissions test diagnostic. Furthermore, if, while conducting the evaporative emissions test under boost conditions, positive pressure in the fuel system and evaporative emissions system is indicated, then it may be indicated that the first check valve (CV1) (e.g. 153) is stuck in an open configuration. Still further, responsive to an indication that the threshold vacuum is not reached during conducting the evaporative emissions test diagnostic, it may be indicated that either gross undesired emissions are present, or that CV2 is stuck closed. Whether the threshold vacuum is indicated to be reached or not, the results of the evaporative emissions test diagnostic procedure may be stored at the controller, as discussed in further detail below.

Method 700 will be described with reference to the systems described herein and shown in FIGS. 1-3D, though it should be understood that similar methods may be applied to other systems without departing from the scope of this disclosure. Method 700 may be carried out by a controller, such as controller 166 in FIG. 1, and may be stored at the controller as executable instructions in non-transitory memory. Instructions for carrying out method 700 and the rest of the methods included herein may be executed by the controller based on instructions stored on a memory of the controller and in conjunction with signals received from sensors of the engine system, such as the sensors described above with reference to FIGS. 1-3D. The controller may employ fuel system and evaporative emissions system actuators, such as canister purge valve (CPV) (e.g., 158), ELCM COV (e.g. 315), FTIV (e.g. 191), etc., according to the method below.

Method 700 begins at 705 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Continuing at 710, method 700 may include indicating whether conditions for an evaporative emissions test under boost are met. For example, conditions for an evaporative emissions test under boost being met may include an indication of manifold air pressure (MAP) greater than barometric pressure (BP) by a predetermined threshold amount. In some examples, conditions being met at 710 may include MAP greater than BP by a predetermined threshold for a predetermined time duration. Conditions being met at 710 may in some examples further include an indication that an evaporative emissions test diagnostic on the evaporative emissions control system and fuel system under boost conditions has not already been conducted during the current drive cycle. Conditions being met at 710 may in some examples further include an indication that a fuel vapor canister purge event is not in progress. Still further, conditions being met at 710 may in some examples include no prior indication of undesired evaporative emissions in the fuel system and/or evaporative emissions system, and no prior indication of CV2 (e.g., 170) being stuck closed.

If, at 710, conditions for an evaporative emissions test diagnostic procedure under boost are not indicated to be met, method 700 may proceed to 715. At 715, method 700 may include maintaining current vehicle operating status. For example, at 715, method 700 may include maintaining the CPV in its current configuration, maintaining the FTIV in its current configuration, and maintaining the ELCM COV in its current configuration. Furthermore, other engine system actuators such as throttle, fuel injectors, etc., may be maintained in their current status. Method 700 may then end.

Returning to 710, if it is indicated that conditions for an evaporative emissions test diagnostic procedure are met, method 700 may proceed to 720. At 720, method 700 may include commanding (e.g. actuating) the ELCM COV to the second position. Such a configuration is depicted above with regard to FIGS. 3B and 3D. However, it may be understood that the ELCM pump (e.g. 330) may be maintained off at 720. Furthermore, the FTIV may be commanded open (e.g. actuated open) to fluidically couple the fuel system to the evaporative emissions system. As discussed above with regard to FIG. 6, in some examples the FTIV may be maintained closed at 720, such that only the evaporative emissions system may be diagnosed for the presence or absence of undesired evaporative emissions, without departing from the scope of this disclosure. In such an example, the ELCM pressure sensor (e.g. 296) may be utilized to monitor pressure in the evaporative emissions system, as discussed above at FIG. 6. Proceeding to 725, method 700 may include commanding open (actuating open) the CPV. By commanding the ELCM COV to the second position, and commanding open the CPV, vacuum derived from the ejector (e.g., 140) under boost conditions may be applied to the evaporative emissions system (e.g., 154) and fuel system (e.g., 106). More specifically, by commanding the ELCM COV to the second position at step 720, the evaporative emissions system and fuel system may be sealed from atmosphere. By commanding open the CPV at 725, vacuum derived from the ejector may be applied to the sealed evaporative emissions system and fuel system (or in some examples just the evaporative emissions system under conditions where the FTIV is maintained closed).

However, in a case where CV1 is stuck open, rather than negative pressure (e.g. vacuum) being indicated in the fuel system and evaporative emissions system, instead, a positive pressure with respect to atmospheric pressure may be indicated. More specifically, in the case of a stuck open CV1, positive pressure in the intake manifold may be communicated to the fuel system and evaporative emissions system. Accordingly, if positive pressure is indicated, then it may be determined that the CV1 is stuck open.

Thus, proceeding to 730, method 700 may include monitoring pressure in the evaporative emissions system and fuel system. For example, monitoring for a positive pressure build or vacuum build (e.g., negative pressure with respect to atmospheric pressure) may include monitoring pressure via a pressure sensor (e.g., 107), positioned in the fuel system and/or evaporative emissions system. Monitoring pressure in the fuel system and evaporative emissions system at 730 may be conducted for a predetermined time duration, in some examples.

Proceeding to 735, method 700 may include indicating whether a positive pressure build in the fuel system and evaporative emissions system is greater than a predetermined positive pressure threshold. If, at 735, positive pressure greater than the positive pressure threshold is indicated, method 700 may proceed to 740, and may include indicating that the CV1 is in a stuck open configuration. Proceeding to 745, the result may be stored at the controller, for example. Furthermore, a malfunction indicator light (MIL) may be illuminated on the vehicle dash to alert the vehicle operator of the need to service the vehicle. Furthermore, as discussed above and which will be discussed in more detail below, responsive to an indication that the CV1 is stuck open, the controller may prevent a test diagnostic for whether or not the CV2 is stuck open from being conducted. Method 700 may then proceed to 750, and may include commanding closed the CPV, and configuring the ELCM COV in the first position such that the fuel system and evaporative emissions system may be coupled to atmosphere. Responsive to an indication that pressure in the fuel system and evaporative emissions system has returned to atmospheric pressure, the FTIV may be commanded closed to seal the fuel system. Method 700 may then end.

Returning to 735, responsive to an absence of an indication of a positive pressure build in the fuel system and evaporative emissions system, method 700 may proceed to 755, and may include indicating whether a vacuum build as monitored by the pressure sensor during evacuating the evaporative emissions system and fuel system is greater than a predetermined vacuum build threshold. The predetermined threshold may in some examples be a function of atmospheric pressure. For example, the predetermined threshold may comprise a decreased vacuum level responsive to decreasing barometric pressure, and increased vacuum level responsive to increasing barometric pressure.

At 755, if it is indicated that vacuum build in the fuel system and evaporative emissions system has reached the predetermined threshold, method 700 may proceed to 770. At 770, method 700 may further include indicating that CV2 (e.g., 170) is not stuck closed. If CV2 were stuck closed, then the pressure sensor (e.g., 107) would not have registered a change in pressure during evacuating the fuel system and evaporative emissions system. Furthermore, at 770, it may be indicated that there are no gross undesired evaporative emissions stemming from the fuel system and/or evaporative emissions system.

Proceeding to 775, method 700 may include closing the CPV to isolate the fuel system and evaporative emissions system from atmosphere and from engine intake, and monitoring a pressure bleed-up in the fuel system and evaporative emissions system. Again, pressure may be monitored by a pressure sensor (e.g., 107). Pressure may be monitored for a predetermined duration, in some examples. If pressure in the fuel system and evaporative emissions system reaches a predetermined threshold pressure, or if a rate of pressure bleed-up exceeds a predetermined pressure bleed-up rate, then non-gross undesired evaporative emissions may be indicated. However, if, during the predetermined duration, pressure does not reach the predetermined threshold pressure, or if the rate of pressure bleed-up does not exceed the predetermined pressure bleed-up rate, then it may be indicated that non-gross undesired evaporative emissions are not present. As such, step 775 comprises testing for presence or absence of non-gross undesired evaporative emissions by comparing a pressure change in the fuel system or evaporative emission system to a reference pressure change after evacuating the fuel system and evaporative emissions system.

Proceeding to step 765, method 700 may include storing the results of the evaporative emissions test diagnostic procedure at the controller. Continuing to 750, method 700 may include maintaining closed the CPV, and commanding the ELCM COV to the first position. By maintaining closed the CPV, the fuel system and evaporative emissions system may be sealed from engine intake (and from the ejector). Furthermore, by commanding the ELCM COV to the first position, pressure in the fuel system and evaporative emissions system may be relieved. Responsive to pressure in the fuel system and evaporative emissions system reaching atmospheric pressure, the FTIV may be commanded (e.g. actuated) closed. Method 700 may then end.

Returning to 755, if it is indicated that vacuum build in the fuel system and evaporative emissions system did not reach the predetermined threshold vacuum, method 700 may proceed to 760. At 760, method 700 may include indicating that either CV2 is stuck closed, or that gross undesired evaporative emissions are present in the fuel system and evaporative emissions system. In other words, the vacuum build may have been prevented from reaching the predetermined vacuum threshold due to the CV2 being stuck closed, or due to gross undesired evaporative emissions. Accordingly, a conclusive determination as to the source of the failure to reach the predetermined threshold vacuum may not be indicated at 760. Instead, method 700 may proceed to 765. At 765, method 700 may include storing the results of the evaporative emissions test diagnostic at the controller. In some examples, responsive to an indication that the evaporative emissions system is free from undesired evaporative emissions, as conducted according to the method depicted at FIG. 6, then if the vacuum build according to FIG. 7 is not reached, it may be indicated that the second check valve is stuck closed.

Continuing to 750, method 700 may include commanding closed the CPV, and commanding the ELCM COV to the first position. As described above, by commanding closed the CPV, the fuel system and evaporative emissions system may be sealed from engine intake (and from the ejector). Furthermore, by commanding the ELCM COV to the first position, pressure in the fuel system and evaporative emissions system may be relieved. Responsive to pressure in the fuel system and evaporative emissions system reaching atmospheric pressure, the FTIV may be commanded closed. Method 700 may then end.

FIGS. 6-7 depict examples for determining the presence or absence of undesired evaporative emissions, and for diagnosing whether the CV1 is stuck open or closed, and for whether the second check valve is stuck closed. However, in some examples, only the test according to FIG. 7 may be conducted, without departing from the scope of this disclosure. For example, if a test under boosted engine operation according to FIG. 7 indicates that the CV1 is not stuck closed, and further indicates the absence of undesired evaporative emissions in the fuel system and evaporative emissions system, then such an indication may enable the test for a stuck-open CV2, discussed below with regard to FIG. 9. However, by conducting both the evaporative emissions test diagnostic under both natural aspiration (e.g. FIG. 6), and boosted engine operation (e.g. FIG. 7), it may be further indicated as to whether the CV1 or CV2 are stuck closed.

Turning now to FIG. 8, an example timeline 800 is shown for determining whether a first check valve (CV1) (e.g. 153) is stuck open or closed, whether a second check valve (CV2) (e.g. 170) is stuck closed, and whether undesired evaporative emissions are present in a vehicle fuel system and evaporative emissions system. Example timeline 800 may be carried out according to the methods described herein and with reference to FIGS. 5-7, and as applied to the systems described herein and with reference to FIGS. 1-3D. Timeline 800 includes plot 805, indicating whether conditions are met for conducting an evaporative emissions test under boosted engine operation, and plot 810, indicating whether conditions are met for conducting an evaporative emissions test under natural aspiration conditions (e.g. engine intake manifold vacuum), over time. Timeline 800 further includes plot 815, indicating manifold air pressure in relation to barometric pressure (BP), over time. Such an indication may be made by a pressure sensor (e.g. 117) positioned in the intake manifold. Timeline 800 further includes plot 820, indicating whether a canister purge valve (CPV) (e.g. 158) is open or closed, plot 823, indicating whether a fuel tank isolation valve (FTIV) (e.g. 191) is open or closed, and plot 825, indicating a position of an ELCM changeover valve (COV) (e.g. 315), over time. ELCM COV may be in a first position, as discussed above with regard to FIG. 3A and FIG. 3C, or in a second position, as discussed above with regard to FIG. 3B and FIG. 3D.

Timeline 800 further includes plot 830, indicating pressure in a vehicle fuel system and evaporative emissions system, over time. Line 831 represents a vacuum build threshold, which, if reached during an evaporative emissions test under boost or natural aspiration conditions, may indicate an absence of gross undesired evaporative emissions. Line 832 represents a pressure bleedup threshold, which, if reached during a pressure bleedup phase of either an evaporative emissions test under boost or natural aspiration conditions, may indicate the presence of non-gross undesired evaporative emissions. Timeline 800 further includes plot 835, indicating whether the CV1 is stuck closed, and plot 840, indicating whether the CV1 is stuck open, over time. Timeline 800 further includes plot 845, indicating whether the CV2 is stuck closed, over time. Timeline 800 further includes plot 850, indicating whether undesired evaporative emissions are indicated in the fuel system and evaporative emissions system, over time.

As discussed above with regard to FIGS. 6-7, in some examples, only the evaporative emissions system may be diagnosed as to the presence or absence of undesired evaporative emissions, by keeping the FTIV closed during the tests under natural aspiration conditions (FIG. 6) and boosted engine operation (e.g. FIG. 7). However, in this example timeline 800, both the fuel system and evaporative emissions system are indicated to be diagnosed, as will be discussed below.

At time t0, while not explicitly illustrated, it may be understood that the vehicle is in operation, and that the vehicle is operating via the engine combusting fuel to propel the vehicle. Conditions for conducting an evaporative emissions test under either boost or natural aspiration conditions are not indicated to be met, as the manifold air pressure is indicated to be near barometric pressure. The CPV is closed, and the ELCM COV is in the first position. The FTIV is closed, however fuel tank pressure is near atmospheric pressure. The CV1 is not indicated to be either stuck open or closed, and the CV2 is not indicated to be stuck closed. Furthermore, undesired evaporative emissions in the fuel system and evaporative emissions system are not indicated.

Between time t0 and t1, manifold air pressure (MAP) decreases below barometric pressure. At time t1, conditions are indicated to be met for conducting an evaporative emissions test under natural aspiration conditions. As discussed above, conditions being met for an evaporative emissions test under natural aspiration may include an indication of manifold air pressure (MAP) less than barometric pressure (BP) by a predetermined threshold amount, an indication that an evaporative emissions test under natural aspiration conditions has not already been conducted during the current drive cycle, an indication that a purge event is not in progress, no prior indication of undesired evaporative emissions in the fuel system and evaporative emissions system, and no prior indication of CV1 being stuck closed.

With conditions for conducting an evaporative emissions test under natural aspiration conditions being met at time t1, the ELCM COV is commanded to the second position, the FTIV is commanded open, and the CPV is commanded open. More specifically, commanding open the FTIV may fluidically couple the fuel system to the evaporative emissions system. Furthermore, commanding the ELCM COV to the second position may seal the fuel system and evaporative emissions system from atmosphere. Still further, opening the CPV may communicate engine manifold vacuum to the sealed fuel system and evaporative emissions system.

Between time t1 and t2, pressure in the fuel system and evaporative emissions system as monitored by the FTPT (e.g. 107) becomes negative with respect to BP. At time t2, pressure in the fuel system and evaporative emissions system reaches the vacuum build threshold. As the vacuum build threshold was reached, gross undesired evaporative emissions are not indicated. Furthermore, as the vacuum build threshold was indicated to be reached, the CV1 is not indicated to be stuck closed. However, it may be possible that the CV1 is in a stuck open configuration. Whether the CV1 is stuck open may be indicated by conducting an evaporative emissions test under boost conditions, as discussed above, and which will be discussed in further detail below.

With the vacuum build threshold reached at time t2, the CPV is commanded closed, thus sealing the fuel system and evaporative emissions system from engine intake. Between time t2 and t3, pressure bleedup in the fuel system and evaporative emissions system is monitored. In some examples, pressure may be monitored for a predetermined duration, which in this example timeline 800 may comprise the duration between time t2 and t3.

Between time t2 and t3, pressure in the fuel system and evaporative emissions system rises, but remains below the pressure bleedup threshold, represented by line 832. Accordingly, non-gross undesired evaporative emissions are not indicated. With the test completed, conditions are no longer indicated to be met for conducting the test for undesired evaporative emissions under natural aspiration conditions. Accordingly, the ELCM COV is commanded to the first position, to couple the fuel system and evaporative emissions system to atmosphere. With the fuel system and evaporative emissions system coupled to atmosphere, pressure in the fuel system and evaporative emissions system returns to atmospheric pressure between time t3 and t4. Responsive to pressure in the fuel system and evaporative emissions system reaching atmospheric pressure, the FTIV is commanded closed at time t4 to seal the fuel system from the evaporative emissions system.

Between time t4 and t5, manifold air pressure rises and becomes positive with respect to BP. Thus, at time t5, conditions are indicated to be met for conducting an evaporative emissions test under boosted engine operation. As discussed above, conditions being met for conducting an evaporative emissions test under boosted engine operation includes an indication of manifold air pressure (MAP) greater than BP by a predetermined threshold, an indication that an evaporative emissions test under boost conditions has not already been conducted during the current drive cycle, an indication that a purge event is not in progress, no prior indication of undesired evaporative emissions in the fuel system and/or evaporative emissions system, and no prior indication of CV2 (e.g. 170) being stuck closed.

With conditions for conducting the evaporative emissions test under boosted engine operation being indicated to be met at time t5, the ELCM COV is commanded to the second position, the FTIV is commanded to the open position, and the CPV is commanded to the open position. As discussed above, opening the FTIV may fluidically couple the fuel system and evaporative emissions system, and configuring the ELCM COV to the second position may seal the fuel system and evaporative emissions system from atmosphere. Furthermore, by commanding open the CPV, vacuum derived from the ejector system under boosted engine operation may be communicated to the fuel system and evaporative emissions system.

Between time t5 and t6, pressure in the fuel system and evaporative emissions system drops with respect to BP, and at time t6, the vacuum build threshold is indicated to have been reached. Accordingly, no gross undesired evaporative emissions are indicated. Furthermore, because the vacuum build threshold was reached at time t6, it may be further indicated that the CV2 is not stuck closed. If the CV2 were stuck closed, the vacuum build threshold would not be expected to be reached. Still further, because the vacuum build threshold was indicated to be reached, and positive pressure was not indicated, it may be indicated that the CV1 is not in a stuck open configuration. If the CV1 was stuck open, a positive pressure build with respect to atmospheric pressure would have been indicated in the fuel system and evaporative emissions system.

With the vacuum build threshold reached at time t6, the CPV is commanded closed to seal the fuel system and evaporative emissions system from engine intake. Between time t6 and t7, pressure in the fuel system and evaporative emissions system is monitored. As discussed above, pressure in the fuel system and evaporative emissions system may be monitored for a predetermined duration, which in this example timeline corresponds to the duration between time t6 and t7. Between time t6 and t7, pressure in the fuel system and evaporative emissions system remains below the pressure bleedup threshold, and accordingly, non-gross undesired evaporative emissions are not indicated.

As the test is complete at time t7, conditions for conducting the evaporative emissions test under boosted engine operation are no longer indicated to be met. Thus, at time t7, the ELCM COV is commanded to the first position. As discussed above, with the ELCM COV commanded to the first position, the fuel system and evaporative emissions system may be coupled to atmosphere, to relieve pressure in the fuel system and evaporative emissions system. Accordingly, between time t7 and t8, pressure in the fuel system and evaporative emissions system returns to atmospheric pressure. With pressure in the fuel system and evaporative emissions system at atmospheric pressure, the FTIV is commanded closed at time t8, thus sealing the fuel system from the evaporative emissions system. Between time t8 and t9, the vehicle remains in operation.

By conducting tests for undesired evaporative emissions under both natural aspiration conditions and under boosted engine operation in a single drive cycle, it may be determined whether undesired evaporative emissions are present in the fuel system and evaporative emissions system, and it may be further indicated as to whether the CV1 is stuck open or closed, and whether the CV2 is stuck closed. Thus, returning to the high level method depicted at FIG. 5, conducting the test for undesired evaporative emissions under both boosted engine operation and under natural aspiration conditions may serve to provide an indication as to whether undesired evaporative emissions are present in the fuel system and evaporative emissions system, and whether the CV1 is stuck open, as depicted by step 505 of method 500. If, at 510, the CV1 is not indicated to be stuck open, and further responsive to an indication of an absence of undesired evaporative emissions in the fuel system and evaporative emissions system, method 500 may proceed to 520 and may include diagnosing whether the CV2 is stuck open, as will be discussed with regard to FIG. 9 below.

Furthermore, while it is illustrated in FIGS. 7 and 8 that the pressure bleedup phase of the evaporative emissions test under boosted engine operation is conducted, in some examples only the vacuum build portion of the evaporative emissions test under boosted engine operation may be conducted. For example, in a case where gross and non-gross undesired evaporative emissions are not indicated as determined via the test for undesired evaporative emissions under natural aspiration conditions, conducting the test for non-gross undesired evaporative emissions under boosted engine operation may not conducted. In such an example, only the vacuum build portion of the test for undesired evaporative emissions under boosted engine operation may be conducted, as the point of the test is to indicate whether positive pressure with respect to atmospheric pressure is indicated, which would imply a stuck open CV1 as discussed above.

Turning now to FIG. 9, a high-level example method 900 for conducting a test to determine whether a second check valve (CV2) (e.g. 170) positioned upstream of an ejector system (e.g. 141), and downstream of a CPV (e.g. 158) is stuck open. More specifically, method 900 may be used responsive to an indication of an absence of undesired evaporative emissions in a vehicle fuel system and evaporative emissions system (or in some examples only the evaporative emissions system), and further responsive to an indication that a first check valve (CV1) (e.g. 153) is not stuck in an open configuration.

Method 900 will be described with reference to the systems described herein and shown in FIGS. 1-4B, though it should be understood that similar methods may be applied to other systems without departing from the scope of this disclosure. Method 900 may be carried out by a controller, such as controller 166 in FIG. 1, and may be stored at the controller as executable instructions in non-transitory memory. Instructions for carrying out method 900 and the rest of the methods included herein may be executed by the controller based on instructions stored on a memory of the controller and in conjunction with signals received from sensors of the engine system, such as the sensors described above with reference to FIGS. 1-2. The controller may employ fuel system and evaporative emissions system actuators, such as canister purge valve (CPV) (e.g. 158), ELCM COV (e.g. 315), FTIV (e.g. 191), ELCM pump (e.g. 330), etc., according to the method below.

Method 900 begins at 905 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Continuing to 910, method 900 may include indicating whether conditions are met for conducting a test to determine whether the CV2 is stuck in an open configuration. Conditions being met for conducting such a test may include an indication of an absence of undesired evaporative emissions in the fuel system and evaporative emissions system (or in some examples just the evaporative emissions system), and an indication that CV1 is not stuck open. Conditions being met for conducting the stuck-open CV2 test may further include an engine-off event, such as may occur during an idle stop event where the engine is deactivated at a stop, or a condition where the vehicle is being propelled via an onboard energy storage device, such as a battery, for example. Conditions being met for conducting the stuck-open CV2 test may further include an indication that a stuck-open CV2 test has not been conducted in the same drive cycle. In some examples, conditions being met for conducting the stuck-open CV2 test may further include an indication that the diagnosis of CV1 not being stuck open, and that the diagnosis of the absence of undesired evaporative emissions were both conducted in the same drive cycle as the stuck-open CV2 test. In other examples, the diagnosis of the CV1 not being stuck open and the absence of undesired evaporative emissions may not be conducted in the same drive cycle as the stuck-open CV2 test, but the stuck-open CV2 test may need to be conducted within a threshold duration since the indication of the absence of undesired evaporative emissions and that the CV1 is not stuck open.

Still further, conditions being met for conducting the stuck-open CV2 test at 910 may include an indication of a canister load above a canister load threshold. For example, if canister load was low, the stuck-open CV2 test may not be robust, as the stuck-open CV2 test relies on a fuel vapor canister temperature change due to desorption of fuel vapors, as will be discussed in further detail below. Thus, if canister load is below the canister load threshold, then conditions may not be indicated to be met for conducting the stuck-open CV2 test at 910.

If, at 910, conditions are not indicated to be met for conducting the stuck-open CV2 test, method 900 may proceed to 915 and may include maintaining vehicle operating parameters. For example, maintaining vehicle operating parameters at 915 may include maintaining the CPV, ELCM COV, ELCM pump, FTIV, etc., in their current operational states. Maintaining vehicle operating parameters at 915 may further include maintaining engine operation if the engine is in operation, etc. Method 900 may then end.

Returning to 910, if conditions for conducting the stuck-open CV2 test are indicated to be met, method 900 may proceed to 920. At 920, method 900 may include commanding open (e.g. actuating open) the CPV, and maintaining closed the FTIV. By actuating open the CPV, the evaporative emissions system may be fluidically coupled to CV2. Proceeding to 925, method 900 may include configuring the ELCM COV in the second position, and may further include activating the ELCM pump to draw vacuum on the evaporative emissions system. Such a configuration of the ELCM pump and the ELCM COV is indicated at FIG. 3B. By maintaining the FTIV closed, fuel vapors in the fuel system may be maintained in the fuel tank, rather than being drawn into the fuel vapor canister, which would confound the interpretation of the stuck-open CV2 test. More specifically, the CV2 test relies on drawing a vacuum on the evaporative emissions system, and if a canister temperature decrease is indicated, then it may be indicated that the CV2 is stuck open, because a stuck open CV2 would allow fresh air to be drawn to the fuel vapor canister which may result in desorption of fuel vapors, thus cooling the canister. If the FTIV were open, interpretation of such a test may not be robust due to fuel vapors from the tank being drawn to the fuel vapor canister where they may be adsorbed.

In some examples, the ELCM pump may be activated for a predetermined duration. For example, the predetermined duration may comprise a duration where it is expected that, if the CV2 were stuck open, then a temperature change would be indicated as monitored via one or more temperature sensors (e.g. 157) coupled to and/or within the fuel vapor canister.

Furthermore, while not explicitly shown in FIG. 1, it may be understood that the temperature sensor(s) may be positioned as close as possible to where fuel vapors exit the canister during a purging event. By placing the temperature sensor(s) in such a location, a temperature change may be indicated with minimal desorption of fuel vapors from the canister. More specifically, the temperature sensor(s) may be positioned in the fuel vapor canister as close as possible to the purge line (e.g. 150).

Accordingly, with the ELCM COV configured in the second position, and with the ELCM pump activated to draw a vacuum on the fuel system and evaporative emissions system, method 900 may proceed to 930. At 930, method 900 may include indicating whether a change in temperature (e.g. a drop in temperature) as indicated via the one or more canister temperature sensor(s), is greater than a canister temperature change threshold. If, at 930, a canister temperature change that is not greater than the canister temperature change threshold (or no temperature change is indicated), then method 900 may proceed to 935. At 935, method 900 may include indicating that the CV2 is not stuck open. Such a result may be stored at the controller, for example.

Responsive to an indication that the CV2 is not stuck open, method 900 may proceed to 945, and may include stopping the ELCM pump, commanding the COV to the first position, and may further include closing the CPV. Method 900 may then proceed to method 1000 depicted below at FIG. 10.

Returning to 930, responsive to an indication of a decrease in canister temperature greater than the canister temperature change threshold, method 900 may proceed to 940, and may include indicating that the CV2 is stuck in an open configuration. Such a result may be stored at the controller, for example. Furthermore, responsive to the indication of a stuck open CV2, mitigating action may be taken. For example, a malfunction indicator light may be illuminated on the vehicle dash, alerting the vehicle operator of the need to service the vehicle. Furthermore, mitigating action may include adjusting vehicle operating conditions such that the vehicle is operated as frequently as possible in electric mode, so as to avoid unmetered air from leaning out the air/fuel ratio when the engine is operating under natural aspiration conditions.

Proceeding to 945, method 900 may include stopping the ELCM pump, and configuring the ELCM COV in the first position, and may further include closing the CPV. Method 900 may then proceed to method 1000 depicted below at FIG. 10.

While not explicitly illustrated, in some examples, due to the desorption of fuel vapors during the CV2 test when the CV2 is stuck open (although minimal due to the placement of the canister temperature sensor as close as possible to the purge line), method 900 may include reversing operation of the ELCM pump for a predetermined duration responsive to an indication of CV2 being stuck open. More specifically, the ELCM pump may be commanded to pressurize the evaporative emissions system, as illustrated in FIG. 3D. The predetermined duration of ELCM pump activation to pressurize the evaporative emissions system may be sufficiently short as to avoid routing fuel vapors through the open CV2 valve, but may prevent any undesired evaporative emissions from escaping via the vent line prior to a purging event where the fuel vapor canister may be cleaned of adsorbed fuel vapors. In such an example, subsequent to the ELCM pump being activated to pressurize the evaporative emissions system for the predetermined duration, the ELCM pump may be stopped, the ELCM COV commanded to the first position, and the CPV may be commanded closed.

In one example, the ELCM pump may be activated to pressurize (configuration depicted at FIG. 3D) the evaporative emissions system automatically responsive to an indication that the CV2 is stuck open. In other examples, the ELCM may be activated to pressurize the evaporative emissions system responsive to an indication that hydrocarbons are present in the vent line (e.g. 136), as indicated, for example, via a hydrocarbon sensor (e.g. 198). For example, responsive to an indication that CV2 is stuck open and further responsive to an indication of hydrocarbons in the vent line, the ELCM may be activated for the predetermined duration to force fuel vapors away from atmosphere, in the direction of the fuel vapor canister and engine intake.

Still further, in some examples, a bleed canister (e.g. 199) may be positioned in the vent line upstream of the ELCM pump, whereby any fuel vapors that migrate past the ELCM pump may be captured and stored by the bleed canister, rather than being routed to atmosphere. Subsequently, the bleed canister and main canister (e.g. 104) may be cleaned of fuel vapors via a purging operation. Such a purging operation will be discussed below with regard to FIG. 10.

Figure 10:
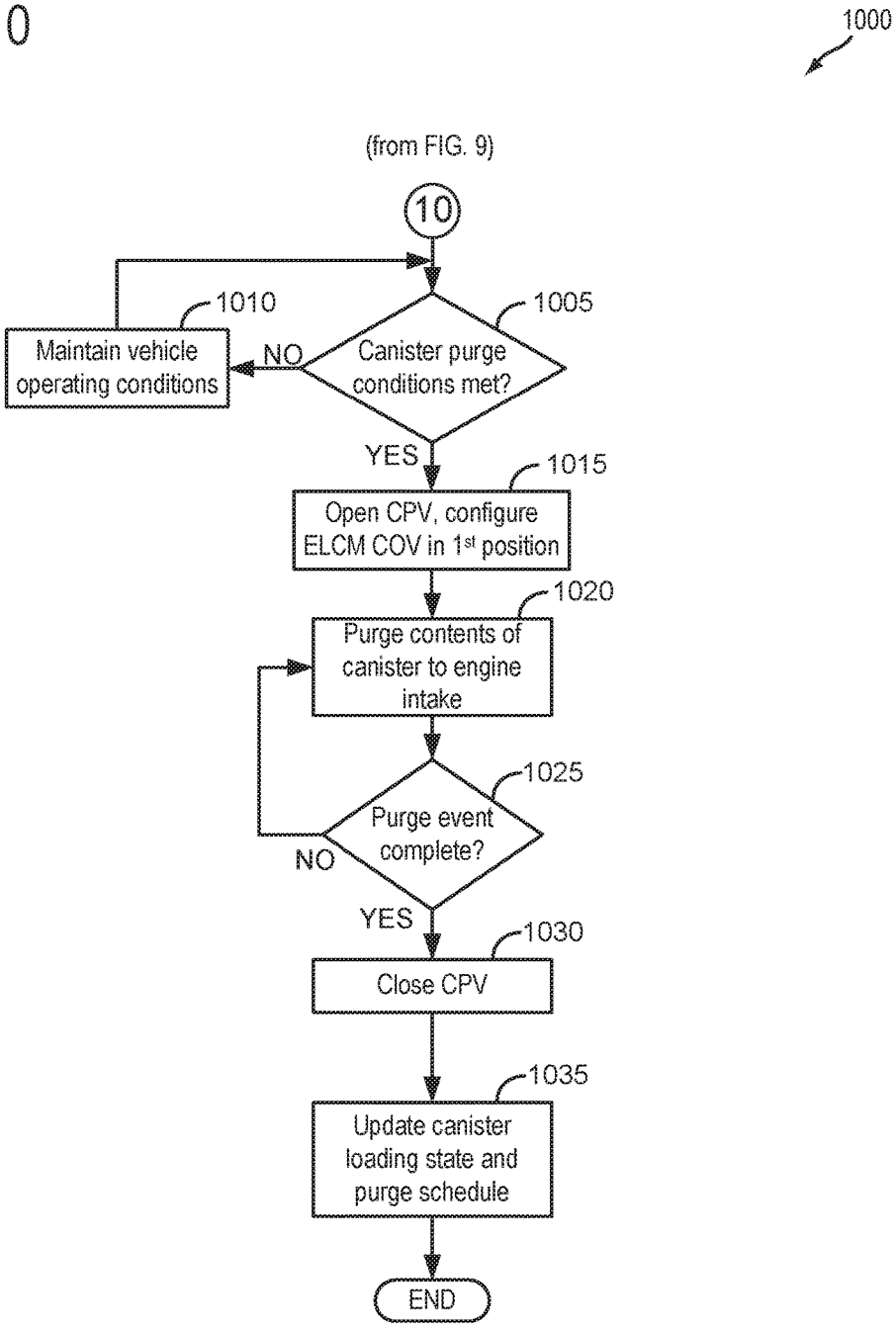
FIG. 10 shows a high-level flowchart for conducting a fuel vapor canister purging operation.
Figure 11:
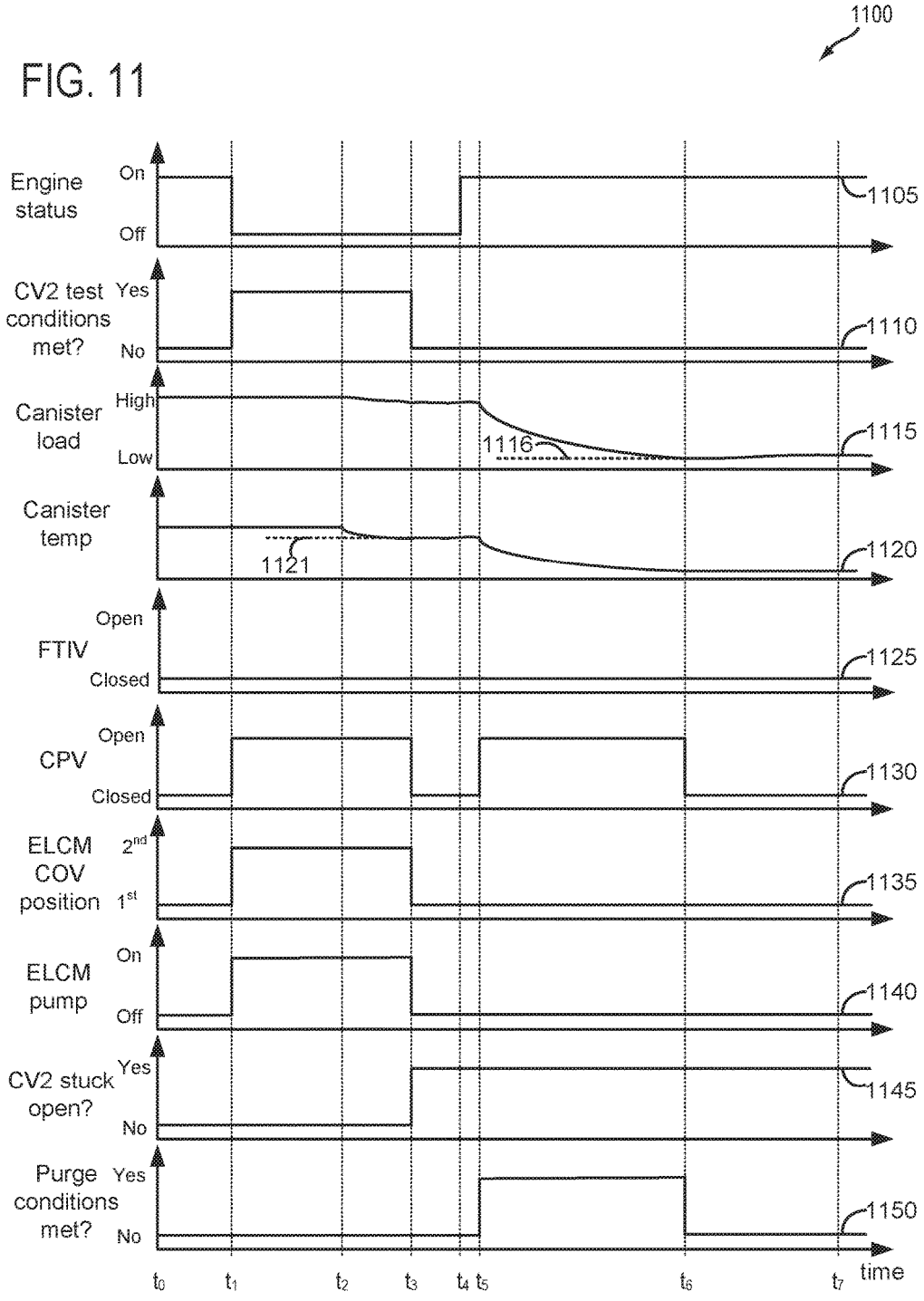
FIG. 11 shows an example timeline for determining whether the second check valve is stuck in an open configuration, and for conducting the fuel vapor canister purging operation.

Turning now to FIG. 10, a flow chart for a high level example method 1000 for conducting fuel vapor canister purging operations, are shown. More specifically, method 1000 may proceed from method 900 and may include purging fuel vapors stored in the fuel vapor canister under select engine operating conditions by commanding open a canister purge valve (CPV) and commanding or maintaining the ELCM COV in the first position, to draw atmospheric air across the fuel vapor storage canister (and in some examples the bleed canister as well) to desorb fuel vapors. Desorbed fuel vapors may be routed through either a first check valve CV1 (e.g., 153) or a second check valve CV2 (e.g., 170) depending on the engine operating conditions.

Method 1000 will be described with reference to the systems described herein and shown in FIGS. 1-3D, though it should be understood that similar methods may be applied to other systems without departing from the scope of this disclosure. Method 1000 may be carried out by a controller, such as controller 166 in FIG. 1, and may be stored at the controller as executable instructions in non-transitory memory. Instructions for carrying out method 1000 and the rest of the methods included herein may be executed by the controller based on instructions stored on a memory of the controller and in conjunction with signals received from sensors of the engine system, such as the sensors described above with reference to FIGS. 1-2. The controller may employ fuel system and evaporative emissions system actuators, such as canister purge valve (CPV) (e.g., 158), ELCM COV (e.g. 315), etc., according to the method below.

Method 1000 begins at 1005 and may include indicating whether conditions are indicated to be met for a fuel vapor canister purging operation. For example, conditions being met for a canister purging operation may include an indication of an amount of fuel vapor stored in the fuel vapor canister greater than a predetermined threshold amount, an estimate or measurement of temperature of an emission control device such as a catalyst being above a predetermined temperature associated with catalytic operation commonly referred to as light-off temperature, etc. Conditions being met may further include an indication of manifold air pressure greater than atmospheric pressure by a threshold amount (e.g. under boosted engine operation), or manifold air pressure less than atmospheric pressure by a threshold amount (e.g. under natural aspiration conditions). Conditions being met at 1005 may further include an indication that the second check valve (CV2) (e.g. 170) is stuck open, as discussed above.

If, at 1005, conditions are not indicated to be met for conducting a canister purging operation, method 1000 may proceed to 1010 and may include maintaining vehicle operating conditions. For example, a status of fuel system and evaporative emissions system actuators (e.g. ELCM COV, CPV, FTIV, etc.), fuel injectors, engine operation, etc., may be maintained. Method 1000 may then end.

Returning to 1005, if conditions are met for conducting a canister purging operation, method 1000 may proceed to 1015. At 1015, method 1000 may include commanding open (e.g. actuating open) the CPV, and may further include configuring the ELCM COV in the first position. With the CPV open and the ELCM COV in the first position, vacuum from either the intake manifold (e.g. natural aspiration conditions), or from the ejector system (e.g. boosted engine operation) may draw fresh air into the fuel vapor canister, which may promote desorption of fuel vapors from the fuel vapor canister.

Accordingly, proceeding to 1020, method 1000 may include purging the contents of the canister to engine intake. In some examples, purging the contents of the fuel vapor canister to engine intake may include purging until a stored fuel vapor amount in the canister is below a predetermined threshold canister load. For example, during purging, a learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister.

More specifically, one or more exhaust gas oxygen sensors (e.g., 125) may be positioned in the engine exhaust to provide an estimate of a canister load (that is, an amount of fuel vapors stored in the canister). Exhaust gas sensor(s) may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Based on the canister load, and further based on engine operating conditions, such as engine speed-load conditions, a purge flow rate may be determined. In one example, purging the canister may include indicating an air/fuel ratio via, for example, a proportional plus integral feedback controller coupled to a two-state exhaust gas oxygen sensor, and responsive to the air/fuel indication and a measurement of inducted air flow, generating a base fuel command. To compensate for purge vapors, a reference air/fuel ratio, related to engine operation without purging, may be subtracted from the air/fuel ratio indication and the resulting error signal (compensation factor) generated. As such, the compensation factor may represent a learned value directly related to fuel vapor concentration, and may be subtracted from the base fuel command to correct for the induction of fuel vapors.

As discussed above with regard to FIG. 1, in other examples one or more oxygen sensors may be positioned in the engine intake (e.g., 116), or coupled to the canister (e.g., 104) (e.g., downstream of the canister), to provide an estimate of canister load. In still further examples, one or more temperature sensors (e.g., 157) may be coupled to and/or within canister (e.g., 104). As fuel vapor is desorbed by the adsorbent in the canister, temperature change may be monitored such that canister load may be estimated based on the temperature change. For example, a temperature decrease during desorption of fuel vapors may be used to estimate canister load.

Thus, continuing to 1025, method 1000 may include indicating whether the purge event is complete. For example, the purging event may be complete when canister load reaches the predetermined threshold canister load. If, at 1025, it is indicated that canister purging is not complete, method 1000 may return to 1020, and may include continuing to purge the contents of the canister to engine intake. However, if at 1025 it is indicated that the purging event is complete, method 1000 may proceed to 1030. At 1030, method 1000 may include commanding closed the CPV. By commanding closed the CPV, the purging operation may be terminated, as the fuel vapor canister may be sealed from the ejector and from engine intake.

Proceeding to 1035, method 1000 may include updating canister loading state responsive to the recent purging event, and updating a canister purge schedule. For example, the canister loading state may be updated at the controller, and the purge schedule updated to reflect the loading state of the fuel vapor canister. Method 1000 may then end.

Turning now to FIG. 11, an example timeline 1100 is shown for conducting a stuck-open second check valve (CV2) (e.g. 170) test, and for subsequently conducting a fuel vapor canister purging operation, according to the methods depicted herein and with regard to FIGS. 5-7, and FIGS. 9-10, and as applied to the systems described herein and with regard to FIGS. 1-4D. Timeline 1100 includes plot 1105, indicating an on or off status of a vehicle engine, and plot 1110, indicating whether conditions are met for conducting a stuck-open CV2 test, over time. Timeline 1110 further includes plot 1115, indicating a fuel vapor canister load, over time. It may be understood that fuel vapor canister load herein refers to the main canister (e.g. 104), in a case where the vehicle includes a bleed canister (e.g. 199). Line 1116 represents a threshold canister load, which, if reached during a purging event may indicate that the fuel vapor canister is substantially free from fuel vapors. Timeline 1100 further includes plot 1120, indicating a canister temperature as monitored via a canister temperature sensor (e.g. 157), over time. Line 1121 represents a canister temperature change threshold, which, if reached during the stuck-open CV2 test, may indicate that the CV2 is stuck open. Timeline 1100 further includes plot 1125, indicating whether an FTIV (e.g. 191) is open or closed, and plot 1130, indicating whether a CPV (e.g. 158) is open or closed, over time. Timeline 1100 further includes plot 1135, indicating whether an ELCM COV (e.g. 315) is in a first position or a second position, and plot 1140, indicating whether an ELCM pump (e.g. 330) is on or off, over time. Timeline 1100 further includes plot 1145, indicating whether the CV2 is stuck open, and plot 1150, indicating whether conditions are met for a fuel vapor canister purging operation, over time.

At time to, the vehicle is in operation with the engine combusting fuel to propel the vehicle. However, as the engine is in operation, conditions are not indicated to be met for conducting a stuck-open CV2 test diagnostic. Canister load is high, indicating that the canister is substantially full of adsorbed fuel vapor. For example, the vehicle may have recently conducted a refueling event, where the fuel vapor canister has not yet been purged. In some examples, responsive to a scheduled stuck-open CV2 test, and where it has been indicated that the evaporative emissions system is free from undesired evaporative emissions and that the CV1 (e.g. 153) is not stuck open, purging may be suspended after refueling until the stuck-open CV2 test has been conducted.

At time t0, the FTIV is closed, sealing the fuel system from the evaporative emissions system, and the CPV is closed, sealing the evaporative emissions system from engine intake. The ELCM COV is configured in the first position, fluidically coupling the evaporative emissions system to atmosphere. The ELCM pump is off, purge conditions are not indicated to be met, and the CV2 is not indicated to be in a stuck-open configuration.

At time t1, the engine is turned off (e.g. deactivated). In this example timeline, while not explicitly illustrated, it may be understood that the engine-off event at time t1 corresponds to an idle stop event. However, in other examples, an engine-off event may correspond to a transition to electric-only propulsion, without departing from the scope of this disclosure.

With the engine turned off at time t1, it is indicated that conditions are met for conducting the stuck-open CV2 diagnostic procedure. As discussed above, conditions being met for conducting the stuck-open CV2 diagnostic procedure may include an indication of an absence of undesired evaporative emissions in the fuel system and evaporative emissions system, and an indication that CV1 is not stuck open. While not explicitly illustrated, in this example timeline it may be understood that the determination that the CV1 is not stuck open and that the fuel system and evaporative emissions system are free from undesired evaporative emissions was indicated in the same drive cycle as the current drive cycle depicted in timeline 1100.

With conditions being met for conducting the stuck-open CV2 diagnostic, the CPV is commanded open, the ELCM COV is commanded to the second position, and the ELCM pump is turned on in a vacuum-mode (illustrated above at FIG. 3B). Accordingly, a vacuum (e.g. negative pressure with respect to atmospheric pressure) is drawn on the evaporative emissions system. Importantly, the FTIV is maintained closed, to prevent fuel vapors from the fuel tank from being drawn into the fuel vapor canister.

Between time t1 and t2, no change in temperature is initially seen at the canister. However, at time t2, temperature in the fuel vapor canister begins to drop, as fuel vapors are desorbed from the canister. At time t3, canister temperature reaches the canister temperature change threshold, represented by line 1121. As the canister temperature change threshold is reached at time t3, it is indicated that the CV2 is stuck open. More specifically, if the CV2 where not stuck open, then no temperature change at the canister would be expected, as no fresh air would be drawn into the evaporative emissions system. However, with the CV2 stuck open, fuel vapors may be drawn into the evaporative emissions system, and to the canister, where the fresh air may promote desorption of fuel vapors, leading to a decrease in temperature as monitored via the canister temperature sensor(s).

Accordingly, at time t3, with the CV2 indicated to be stuck open, the CPV is commanded closed, the ELCM COV is commanded to the first position, and the ELCM pump is turned off. At time t4, the engine is turned on, indicated by plot 1105. With the engine in operation, and the stuck-open CV2 test completed, at time t5 it is indicated that conditions are met for conducting a fuel vapor canister purging operation. Thus, the CPV is commanded open, and the ELCM COV is maintained in the first position. With the CPV open and the ELCM COV in the first position, engine intake manifold vacuum is applied on the fuel vapor canister, to draw fresh air across the canister, thus desorbing fuel vapors from the canister and routing the desorbed fuel vapors to engine intake. As such, between time t5 and t6, canister load decreases, and canister temperature decreases as well, the result of fuel vapors being desorbed from the canister. At time t6, canister load reaches the threshold canister load, indicating that the fuel vapor canister is substantially free from fuel vapors. Thus, at time t6, purge conditions are no longer indicated to be met, and the CPV is commanded closed to seal the evaporative emissions system from engine intake. While example timeline 1100 shows the purging event taking place with the FTIV closed, in some examples the FTIV may be commanded open during the purging operation, to draw fuel vapors from the fuel tank to engine intake for combustion.

Between time t6 and t7, the vehicle is propelled via at least the engine combusting fuel. However, in some examples, the vehicle may be transitioned to an electric mode of operation as frequently as possible responsive to an indication of a stuck-open CV2. In other examples, responsive to an indication of a stuck open CV2, fuel injection may be adjusted so as to maintain the air/fuel ratio at stoichiometry when the vehicle is operating under natural aspiration conditions.

In this way, a second check valve (CV2) whose function is to prevent unmetered air from leaning out the air/fuel ratio during natural aspiration conditions, may be diagnosed as to whether the CV2 is stuck open. Responsive to the CV2 being indicated to be stuck open, mitigating actions may be taken, such as operating the vehicle in electric-only operation as frequently as possible, or adjusting fuel injection to maintain the air/fuel ratio at stoichiometry during natural aspiration conditions. By indicating whether the CV2 is stuck open, NOx emissions resulting from lean engine operation, may be reduced.

The technical effect is to recognize that by operating an ELCM pump to draw a vacuum on the evaporative emissions system under conditions where it is indicated that the first check valve (CV1) is not stuck open, and where undesired evaporative emissions are not present in the evaporative emissions system, it may be indicated as to whether the CV2 is stuck open by monitoring a temperature change at the fuel vapor canister.

The systems described herein, and with reference to FIGS. 1-4B, along with the methods described herein and with reference to FIGS. 5-7, and FIGS. 9-10, may enable one or more systems and one or more methods. In one example, a method comprises storing fuel vapors from a fuel system, which supplies fuel to an engine, in a fuel vapor storage canister; coupling the canister to an air intake of the engine through a second path having a second check valve which prevents unmetered air from being drawn into an intake manifold of the engine; and diagnosing whether the second check valve is stuck open based on a temperature change of the canister. In a first example of the method, the method further comprises controlling pressure in the second path via a pump positioned in a vent line between the fuel vapor canister and atmosphere; and wherein diagnosing whether the second check valve is stuck open includes reducing pressure in the second path via the pump. A second example of the method optionally includes the first example, and further includes wherein reducing pressure in the second path via the pump draws atmospheric air across the second check valve under conditions where the second check valve is stuck open. A third example of the method optionally includes any one or more or each of the first and second examples, and further comprises controlling a flow of fuel vapors from the fuel system to the fuel vapor storage canister via a fuel tank isolation valve; and wherein the fuel tank isolation valve is in a closed configuration during reducing pressure in the second path via the pump to prevent fuel vapors from being drawn into the fuel vapor storage canister. A fourth example of the method optionally includes any one or more or each of the first through third examples, and further comprises indicating the second check valve is stuck open responsive to the temperature change at the fuel vapor canister decreasing to a canister temperature change threshold. A fifth example of the method optionally includes any one or more or each of the first through fourth examples and further comprises preventing positive pressure with respect to atmospheric pressure from being communicated to the fuel vapor canister under conditions of positive pressure in the intake manifold via a first check valve in a first path; and wherein diagnosing whether the second check valve is stuck open includes an indication that the first check valve is not stuck open. A sixth example of the method optionally includes any one or more or each of the first through fifth examples and further includes wherein diagnosing whether the second check valve is stuck open includes an indication that the first path and the second path are free from undesired evaporative emissions. A seventh example of the method optionally includes any one or more or each of the first through sixth examples and further includes wherein diagnosing whether the second check valve is stuck open is conducted while the engine is not in operation.

An example of a system for a vehicle comprises an engine operable under boosted and natural aspiration conditions; a fuel system including a fuel tank which supplies fuel to the engine, selectively coupled to an evaporative emissions system via a fuel tank isolation valve; a fuel vapor storage canister positioned in the evaporative emissions system; an onboard pump, positioned in a vent line between the fuel vapor storage canister and atmosphere, the pump including a changeover valve configurable in a first and a second position; one or more temperature sensor(s) positioned in the fuel vapor storage canister; a pressure sensor positioned in a conduit between the fuel system and evaporative emissions system; a canister purge valve positioned in a purge line downstream of the fuel vapor storage canister; a first check valve, positioned between the canister purge valve and an intake manifold of the engine; a second check valve, positioned between the canister purge valve and an ejector system; and a controller storing instructions in non-transitory memory that, when executed, cause the controller to: in a first condition, indicate whether the first check valve is stuck open based on a monitored pressure change in the fuel system and evaporative emissions system during boosted engine operation; and in a second condition, indicate whether the second check valve is stuck open based on a monitored fuel vapor canister temperature change during an engine-off condition, where the second condition includes an indication that the first check valve is not stuck open. In a first example of the system, the system further includes wherein the controller further stores instructions in non-transitory memory that, when executed, cause the controller to: in the first condition, couple the fuel system to the evaporative emissions system by commanding open the fuel tank isolation valve; seal the fuel system and evaporative emissions system from atmosphere by commanding the changeover valve to the second position; command open the canister purge valve; monitor pressure in the fuel system and evaporative emissions system; and indicate that the first check valve is stuck open responsive to the monitored pressure in the fuel system and evaporative emissions system reaching a predetermined positive pressure threshold. A second example of the system optionally includes the first example and further includes wherein the controller further stores instructions in non-transitory memory that, when executed, cause the controller to: during the first condition, responsive to an indication that the first check valve is not stuck open and a vacuum build in the fuel system and evaporative emissions system reaching a vacuum build threshold due to the ejector system communicating vacuum to the fuel system and evaporative emissions system: command closed the canister purge valve; and indicate the fuel system and evaporative emissions system are free from undesired evaporative emissions responsive to pressure in the fuel system and evaporative emissions system remaining below a predetermined threshold pressure for a predetermined duration. A third example of the system optionally includes any one or more or each of the first and second examples and further includes wherein the controller further stores instructions in non-transitory memory that, when executed, cause the controller to: during natural aspiration conditions, where natural aspiration conditions include pressure in the intake manifold below atmospheric pressure, command open the fuel tank isolation valve; command the changeover valve to the second position; command open the canister purge valve; and responsive to pressure in the fuel system and evaporative emissions system reaching a predetermined vacuum build threshold: command closed the canister purge valve; indicate the fuel system and evaporative emissions system are free from undesired evaporative emissions responsive to pressure in the fuel system and evaporative emissions system remaining below a predetermined threshold pressure for a predetermined duration. A fourth example of the system optionally includes any one or more or each of the first through third examples and further includes wherein the second condition includes an indication that the fuel system and evaporative emissions system are free from undesired evaporative emissions. A fifth example of the system optionally includes any one or more or each of the first through fourth examples and further includes wherein the controller further stores instructions in non-transitory memory that, when executed, cause the controller to: in the second condition, command the changeover valve to the second position; command open the canister purge valve; command the onboard pump to draw a vacuum on the evaporative emissions system; and indicate the second check valve is stuck open responsive to a canister temperature decrease greater than a canister temperature change threshold. A sixth example of the system optionally includes any one or more or each of the first through fifth examples and further includes wherein the controller further stores instructions in non-transitory memory that, when executed, cause the controller to: in the second condition, command the onboard pump to apply a positive pressure with respect to atmosphere on the evaporative emissions system for a predetermined duration responsive to an indication of the second check valve being stuck open, during the engine-off condition. A seventh example of the system optionally includes any one or more or each of the first through sixth examples and further comprises monitoring a fuel vapor level in the vent line via a hydrocarbon sensor positioned between the fuel vapor canister and the onboard pump; and wherein the controller further stores instructions in non-transitory memory that, when executed, cause the controller to: in the second condition, command the onboard pump to apply the positive pressure on the evaporative emissions system for the predetermined duration responsive to an indication of the second check valve being stuck open, and further responsive to an indication of the presence of fuel vapors in the vent line, during the engine-off condition. An eighth example of the system optionally includes any one or more or each of the first through seventh examples and further includes wherein the controller further stores instructions in non-transitory memory that, when executed, cause the controller to: responsive to an indication of the second check valve being stuck open, and further responsive to an engine-on event: purge fuel vapors from the evaporative emissions system and fuel vapor canister under either boosted engine operation or natural aspiration conditions by commanding open the canister purge valve, to draw fresh air across the canister to desorb fuel vapors, where the desorbed fuel vapors are routed to the engine for combustion.

Another example of a method comprises storing fuel vapors from a fuel system, which supplies fuel to an engine, in a fuel vapor storage canister; coupling the canister to an air intake of the engine through a second path having a second check valve; and during a test condition, drawing a vacuum in the second path through the canister and diagnosing whether the second check valve is stuck open based on a temperature change of the canister. In a first example of the method, the method further comprises coupling the canister to the air intake of the engine through a first path having a first check valve; initiating the test condition responsive to conditions being met for the test condition; and wherein conditions being met for the test condition include an indication that the first check valve is not stuck open, and an indication of an absence of undesired evaporative emissions in the first path and the second path. A second example of the system optionally includes the first example and further comprises monitoring for the presence of hydrocarbons in a vent line coupling the fuel vapor storage canister to atmosphere via a hydrocarbon sensor; and responsive to the indication that the second check valve is stuck open and further responsive to the presence of hydrocarbons being indicated in the vent line: applying a positive pressure on the second path for a predetermined duration to prevent hydrocarbons from escaping to atmosphere.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

storing fuel vapors from a fuel system, which supplies fuel to an engine, in a fuel vapor storage canister;

coupling the fuel vapor storage canister to an air intake of the engine through a second path having a second check valve which prevents unmetered air from being drawn into an intake manifold of the engine when a canister purge valve is open;

diagnosing whether the second check valve is stuck open based on a temperature change of the fuel vapor storage canister;

preventing positive pressure with respect to atmospheric pressure from being communicated to the fuel vapor storage canister under conditions of positive pressure in the intake manifold via a first check valve in a first path; and wherein diagnosing whether the second check valve is stuck open includes an indication that the first check valve is not stuck open.

2. The method of claim 1, further comprising:

controlling pressure in the second path via a pump positioned in a vent line between the fuel vapor storage canister and atmosphere; and wherein diagnosing whether the second check valve is stuck open includes reducing pressure in the second path via the pump.

3. The method of claim 2, wherein reducing pressure in the second path via the pump draws atmospheric air across the second check valve under conditions where the second check valve is stuck open.

4. The method of claim 2, further comprising:

controlling a flow of fuel vapors from the fuel system to the fuel vapor storage canister via a fuel tank isolation valve; and wherein the fuel tank isolation valve is in a closed configuration during reducing pressure in the second path via the pump to prevent fuel vapors from being drawn into the fuel vapor storage canister.

5. The method of claim 1, further comprising:

indicating the second check valve is stuck open responsive to the temperature change at the fuel vapor storage canister decreasing to a canister temperature change threshold.

6. The method of claim 1, wherein diagnosing whether the second check valve is stuck open includes an indication that the first path and the second path are free from undesired evaporative emissions.

7. The method of claim 1, wherein diagnosing whether the second check valve is stuck open is conducted while the engine is not in operation.

8. A system for a vehicle, comprising:

an engine operable under boosted and natural aspiration conditions;

a fuel system including a fuel tank which supplies fuel to the engine, selectively coupled to an evaporative emissions system via a fuel tank isolation valve;

a fuel vapor storage canister positioned in the evaporative emissions system;

an onboard pump, positioned in a vent line between the fuel vapor storage canister and atmosphere, the pump including a changeover valve configurable in a first and a second position;

one or more temperature sensor(s) positioned in the fuel vapor storage canister;

a pressure sensor positioned in a conduit between the fuel system and the evaporative emissions system;

a canister purge valve positioned in a purge line downstream of the fuel vapor storage canister;

a first check valve, positioned between the canister purge valve and an intake manifold of the engine;

a second check valve, positioned between the canister purge valve and an ejector system; and a controller storing instructions in non-transitory memory that, when executed, cause the controller to:

in a first condition, indicate whether the first check valve is stuck open based on a monitored pressure change in the fuel system and the evaporative emissions system during boosted engine operation; and in a second condition, indicate whether the second check valve is stuck open based on a monitored fuel vapor canister temperature change during an engine-off condition, where the second condition includes an indication that the first check valve is not stuck open.

9. The system of claim 8, wherein the controller further stores instructions in non-transitory memory that, when executed, cause the controller to:

in the first condition, couple the fuel system to the evaporative emissions system by commanding open the fuel tank isolation valve;

seal the fuel system and the evaporative emissions system from atmosphere by commanding the changeover valve to the second position;

command open the canister purge valve;

monitor pressure in the fuel system and the evaporative emissions system; and indicate that the first check valve is stuck open responsive to the monitored pressure in the fuel system and the evaporative emissions system reaching a predetermined positive pressure threshold.

10. The system of claim 9, wherein the controller further stores instructions in non-transitory memory that, when executed, cause the controller to:

during the first condition, responsive to an indication that the first check valve is not stuck open and a vacuum build in the fuel system and the evaporative emissions system reaching a vacuum build threshold due to the ejector system communicating vacuum to the fuel system and the evaporative emissions system:

command closed the canister purge valve; and indicate the fuel system and the evaporative emissions system are free from undesired evaporative emissions responsive to pressure in the fuel system and the evaporative emissions system remaining below a predetermined threshold pressure for a predetermined duration.

11. The system of claim 8, wherein the controller further stores instructions in non-transitory memory that, when executed, cause the controller to:

during natural aspiration conditions, where natural aspiration conditions include pressure in the intake manifold below atmospheric pressure, command open the fuel tank isolation valve;

command the changeover valve to the second position;

command open the canister purge valve; and responsive to pressure in the fuel system and the evaporative emissions system reaching a predetermined vacuum build threshold:

command closed the canister purge valve;

indicate the fuel system and the evaporative emissions system are free from undesired evaporative emissions responsive to pressure in the fuel system and the evaporative emissions system remaining below a predetermined threshold pressure for a predetermined duration.

12. The system of claim 8, wherein the second condition includes an indication that the fuel system and the evaporative emissions system are free from undesired evaporative emissions.

13. The system of claim 8, wherein the controller further stores instructions in non-transitory memory that, when executed, cause the controller to:

in the second condition, command the changeover valve to the second position;

command open the canister purge valve;

command the onboard pump to draw a vacuum on the evaporative emissions system; and indicate the second check valve is stuck open responsive to a canister temperature decrease greater than a canister temperature change threshold.

14. The system of claim 8, wherein the controller further stores instructions in non-transitory memory that, when executed, cause the controller to:

in the second condition, command the onboard pump to apply a positive pressure with respect to atmosphere on the evaporative emissions system for a predetermined duration responsive to an indication of the second check valve being stuck open, during the engine-off condition.

15. The system of claim 14, further comprising:

monitoring a fuel vapor level in the vent line via a hydrocarbon sensor positioned between the fuel vapor canister and the onboard pump; and wherein the controller further stores instructions in non-transitory memory that, when executed, cause the controller to:

in the second condition, command the onboard pump to apply the positive pressure on the evaporative emissions system for the predetermined duration responsive to the indication of the second check valve being stuck open, and further responsive to an indication of the presence of fuel vapors in the vent line, during the engine-off condition.

16. The system of claim 8, wherein the controller further stores instructions in non-transitory memory that, when executed, cause the controller to:

responsive to an indication of the second check valve being stuck open, and further responsive to an engine-on event:

purge fuel vapors from the evaporative emissions system and the fuel vapor canister under either boosted engine operation or natural aspiration conditions by commanding open the canister purge valve, to draw fresh air across the fuel vapor storage canister to desorb fuel vapors, where the desorbed fuel vapors are routed to the engine for combustion.

17. A method comprising:

storing fuel vapors from a fuel system, which supplies fuel to an engine, in a fuel vapor storage canister;

coupling the fuel vapor storage canister to an air intake of the engine through a second path having a second check valve;

during a test condition, drawing a vacuum in the second path through the fuel vapor storage canister and diagnosing whether the second check valve is stuck open based on a temperature change of the fuel vapor storage canister; and preventing positive pressure with respect to atmospheric pressure from being communicated to the fuel vapor storage canister during conditions of positive pressure in an intake manifold via a first check valve in a first path.

18. The method of claim 17 further comprising:

coupling the fuel vapor storage canister to the air intake of the engine through the first path having the first check valve;

initiating the test condition responsive to conditions being met for the test condition; and wherein conditions being met for the test condition include an indication that the first check valve is not stuck open, and an indication of an absence of undesired evaporative emissions in the first path and the second path.

19. The method of claim 17, further comprising:

monitoring for a presence of hydrocarbons in a vent line coupling the fuel vapor storage canister to atmosphere via a hydrocarbon sensor; and responsive to the indication that the second check valve is stuck open and further responsive to the presence of hydrocarbons being indicated in the vent line:

applying a positive pressure on the second path for a predetermined duration to prevent hydrocarbons from escaping to atmosphere.

* * * * *